US005746320A

United States Patent [19]

Fujita et al.

[11] Patent Number: 5,746,320

[45] Date of Patent: May 5, 1998

[54] FRICTION ELECTRIFYING-TYPE ELECTROSTATIC SORTING APPARATUS

[75] Inventors: Yoshihisa Fujita, Saitama-ken; Masakatsu Kumagai; Yoshihisa Aizawa, both of Aichi-ken, all of Japan

[73] Assignees: Tooyota Tsusho Corporation, Nagoya; Senko Kogyo Co., Ltd., Tokyo; Toyota Metal Co., Ltd., Nagoya, all of Japan

[21] Appl. No.: 489,689

[22] Filed: Jun. 12, 1995

[30] Foreign Application Priority Data

Jun. 10, 1994 [JP] Japan ..... 6-153008

[51] Int. Cl.[6] ..... B03C 7/00

[52] U.S. Cl. ..... 209/127.3; 209/127.4; 209/128

[58] Field of Search ..... 209/127.1, 127.3, 209/127.4, 128, 129, 130

[56] References Cited

U.S. PATENT DOCUMENTS

| | | | |
|---|---|---|---|
| 3,493,109 | 2/1970 | Carta et al. | 209/127.1 X |
| 3,799,340 | 3/1974 | Tamai et al. | 209/127.1 |
| 5,394,991 | 3/1995 | Kumagai et al. . | |
| 5,542,543 | 8/1996 | Yasukuni | 209/127.4 |

FOREIGN PATENT DOCUMENTS

| | | | |
|---|---|---|---|
| 4222870 | 1/1994 | Germany | 209/127.4 |
| 58-51946 | 3/1983 | Japan . | |
| 62-294453 | 12/1987 | Japan . | |
| 4-74546 | 3/1992 | Japan . | |
| 7-64443 | 3/1995 | Japan . | |

*Primary Examiner*—Tuan Nguyen

*Attorney, Agent, or Firm*—Oblon, Spivak, McClelland, Maier & Neustadt, P.C.

[57] ABSTRACT

A friction electrifying-type electrostatic sorting apparatus having a preliminary friction electrifying unit for preliminarily electrifying a sorted material by providing a friction; a friction electrifying unit for further electrifying the sorted material having been preliminarily electrified by the preliminary friction electrifying unit; a feeding unit for supplying the sorted material having been electrified by the friction electrifying unit; and an electrostatic sorting unit for electrostatically sorting the electrified material supplied from the feeding unit according to the electrified state of the sorted material by providing the sorted material in an electrostatic field.

21 Claims, 16 Drawing Sheets

FRICTION ELECTRIFYING-TYPE ELECTROSTATIC SORTING APPARATUS

BACKGROUND OF THE INVENTION

1. Field of the Invention

This invention relates to a friction electrifying-type electrostatic sorting apparatus for reliably electrostatically sorting a sorted material containing synthetic resin by preliminarily sufficiently electrifying the sorted material with a preliminary friction electrifying unit and a friction electrifying unit.

2. Description of the Prior Art

In a prior art electrostatic sorting apparatus, as shown in FIG. 18, a sorted material which contains synthetic resins, is electrified by providing a friction in a friction electrifying unit M and then sorted by causing positively and negatively electrified materials to be attracted to respective negative and positive poles of an opposed pole-type electrostatic separators S.

However, in this prior art electrostatic sorting apparatus, the sorted material containing the synthetic resins is electrified by providing a friction with the sole friction electrifying unit M. Therefore, the whole sorted material is not electrified uniformly. Such sorted material can not be highly accurately sorted in the opposed pole-type electrostatic separator S, and the sorted material of one kind is contained in a certain ratio in the sorted material of the other kind, as shown in FIG. 18. To obtain increased accuracy of sorting, it is necessary to repeatedly pass the sorted material through the apparatus, thus requiring a long time.

SUMMARY OF THE INVENTION

An object of the present invention is to provide a friction electrifying-type electrostatic sorting apparatus, which permits highly accurate electrostatic sorting.

Another object of the present invention is to provide a friction electrifying-type electrostatic sorting apparatus, which permits sorting such that less sorted material of one kind is contained in the sorted material of the other kind, so that it can meet a requirement of highly accurate sorting in a short period of time without need of repeatedly passing the sorted material through the apparatus and also permits recycling of synthetic resin.

A further object of the present invention is to provide a friction electrifying-type electrostatic sorting apparatus, which is based on a technical concept of the present invention that a sorted material is preliminarily electrified by providing a friction to a certain extent prior to the supply of the sorted material to a friction electrifying unit and then electrified by providing a friction uniformly in the friction electrifying unit before electrostatic sorting by an electrostatic sorting unit.

Polyvinyl chloride (PVC), polyethylene telephthalate (PET), polypropylene (PP), polyethylene (PE), polystyrene (PS), acrylonitrile styrene (AS), acrylonitrile-butadiene-styrene copolymer resin (ABS), methacrylic acid resin (PMMA), polyamide resin (PA), phenol resin (PF) and urea resin (UF) or the like have specific gravities distributed as shown in FIG. 16.

The electrifying series which is obtainable when electrifying general-purpose resins such as the above polyvinyl chloride (PVC), polypropylene (PP), polyethylene (PE), polystyrene (PS) and acrylonitrile-butadiene-styrene copolymer resin (ABS) has no bearing on the above specific gravities and can be arranged from positive to negative as shown in FIG. 17. A further object of the present invention is to provide a friction electrifying-type electrostatic sorting apparatus, which utilizes the above electrifying series of synthetic resins for electrostatic sorting on the basis of the concept of the present invention.

A still further object of the present invention is to provide a friction electrifying-type electrostatic sorting apparatus which comprises a preliminary friction electrifying unit for preliminarily electrifying a sorted material by providing a friction; a friction electrifying unit for further electrifying the sorted material having been preliminarily electrified by the preliminary friction electrifying unit; a feeding unit for supplying the sorted material having been electrified by the friction electrifying unit; and an electrostatic sorting unit for electrostatically sorting the electrified material supplied from the feeding unit according to the electrified state of the sorted material by providing the sorted material in an electrostatic field.

A yet further object of the present invention is to provide a friction electrifying-type electrostatic sorting apparatus wherein the preliminary friction electrifying unit includes a transporting unit, on an inner surface of which a lining of a material containing a synthetic resin for promoting the electrifying of a sorted material and whereby the sorted material is electrified by the lining while being transported.

A yet further object of the present invention is to provide a friction electrifying-type electrostatic sorting apparatus wherein the transporting unit includes a transporting pipe having a lining of an electrifying material containing a synthetic resin provided on an inner surface thereof for the electrifying of a sorted material and a cyclone having an inner surface thereof for the electrifying the sorted material contacted with the inner surface in an enough time, and the friction electrifying unit is a reciprocal friction electrifying unit having a lining of a electrifying suited material provided on an inner surface thereof for electrifying the sorted material.

Another object of the present invention is to provide a friction electrifying-type electrostatic sorting apparatus, wherein the feeding unit is a feed roller disposed near an outlet opening of the friction electrifying unit to supply by its rotation the sorted material having been electrified by the friction electrifying unit; the electrostatic sorting unit comprises a rotary electrode with a positive or negative voltage applied thereto disposed oppose to the feed roller for attracting and sorting the sorted material electrified to a polarity differently from a polarity of the voltage applied thereto; a first separating plate disposed between the feed roller and the rotary electrode, for separating the differently electrified and sorted material in the electrostatic field; and a second separating plate disposed under the feed roller, for separating the sorted material falling due to the own weight and the sorted material forced to fall down from the feed roller.

A further object of the present invention is to provide a friction electrifying-type electrostatic sorting apparatus wherein the rotary electrode is constituted by a plurality of divided electrodes disposed on an outer periphery of a cylindrical member rotated in synchronism to the feed roller, and an additional electrode is provided at the lower end of the first and second separating plates, the additional electrode being given applied voltage of the same polarity as the separated and sorted material for attracting the differently electrified and sorted material contained in the sorted material.

A still further object of the present invention is to provide a friction electrifying-type electrostatic sorting apparatus which comprises swirl causing means for causing a swirl of the sorted material in the transporting pipe to cause sufficient electrifying of the sorted material by friction electrifying before the sorted material is supplied to the cyclone.

A yet further object of the present invention is to provide a friction electrifying-type electrostatic sorting apparatus wherein at least one set of a feed roller and a rotary electrode similar to the feed roller and the rotary electrode is provided down-stream the feed roller and the rotary electrode.

A yet further object of the present invention is to provide a friction electrifying-type electrostatic sorting apparatus which comprises a controller for determining the air flow of a blower, the friction electrifying time of the friction electrifying unit, the voltage applied to and polarity of the rotary electrode, the inclination of the first and second separating plates and so forth according to preliminarily stored data in dependence on the kind of the sorted material, thereby outputting respective control signals; and a control mechanism for controlling the air flow of the blower, the friction electrifying time of the friction electrifying unit, the voltage applied to and polarity of the rotary electrode and the inclination of the first and second separating plates according to the control signals from the controller.

Another object of the present invention is to provide a friction electrifying-type electrostatic sorting apparatus wherein the friction electrifying unit includes a electrified state sensor for detecting the reaching of a predetermined electrified state by the sorted material, whereby upon reaching of the predetermined electrified state of the sorted material, the controller outputs control signal of the supplying unit for supplying the sorted material in the predetermined electrified state to the feed roller, and a electrified state sensor is provided in an accommodation box for accommodating the sorted material, thereby permitting the check of a differently electrified material contained in the sorted material.

A further object of the present invention is to provide a friction electrifying-type electrostatic sorting apparatus which comprises a shredding unit for shredding the sorted material; a screening unit for finely screening the sorted material shredded by the shredding unit for different sizes; and a wind sorting unit for sorting the sorted material having been screened by the screening unit by supplying an air stream at a predetermined speed to the sorted material into the heavy and light sorted materials, the shredding unit, screening unit and wind sorting unit being provided on the upstream side of the friction electrifying unit.

In a friction electrifying-type electrostatic sorting apparatus according to a first aspect of the present invention, the sorted material is preliminarily electrified by providing a friction by a preliminary friction electrifying unit and then electrified by providing a friction by a friction electrifying unit before being supplied by a feeding unit to an electrostatic sorting unit to be sorted in an electrostatic field in dependence on the electrifying state of the sorted material.

In a friction electrifying-type electrostatic sorting apparatus according to a second aspect of the present invention, the sorted material which contains a synthetic resin, is preliminarily electrified during its transport with the friction provided by a lining of a material for promoting the electrifying of the sorted material during its transport, the lining being provided on the inner surface of a transporting unit constituting a preliminary friction electrifying unit, while the same effects as according to the first aspect of the present invention can be obtained.

In a friction electrifying-type electrostatic sorting apparatus according to a third aspect of the present invention, the sorted material which contains a synthetic resin, is preliminarily electrified during its transport with the friction provided by a lining of a material for promoting the electrifying of the sorted material, the lining being provided on the inner surface of a transporting pipe constituting a preliminary friction electrifying unit, then the sorted material is further electrified by providing a friction in contact for a sufficient period of time with a lining of a material suited for the electrifying of the sorted material, the lining being provided on the inner surface of a cyclone, and the preliminarily electrified material is still further electrified with the friction provided by a lining of a material suited for the electrifying, the lining being provided on the inner surface of a reciprocal friction electrifying unit constituting a friction electrifying unit, while the same effects as according to the first aspect of the present invention can be obtained.

In a friction electrifying-type electrostatic sorting apparatus according to a fourth aspect of the present invention, the sorted material having been electrified by the friction electrifying unit is supplied with the rotation of a feed roller which is provided as a feeding unit disposed near the outlet opening of the friction electrifying unit, a rotary electrode which is disposed as an electrostatic sorting unit such as to face the feed roller and is receiving a positive or negative voltage applied to the electrode attracts the sorted material electrified differently from the polarity of the voltage applied to the electrode, a first separating plate which is disposed between the feed roller and the rotary electrode separates the differently electrified material in an electrostatic field, and a second separating plate disposed beneath the feed roller separates the sorted material which falls due to the own weight from the sorted material which is forcibly caused to fall by the feed roller, while the same effects as according to the third aspect of the present invention can be obtained.

In a friction electrifying-type electrostatic sorting apparatus according to a fifth aspect of the present invention, among a plurality of divided electrodes provided as the rotary electrode on the outer periphery of a cylindrical member rotated in synchronism with the feed roller, one which faces the feed roller receives an applied voltage to attract the sorted material electrified differently from the polarity of the applied voltage on that electrode in the sorted material supplied by the feed roller, with the rotation of the cylindrical member, the voltage application to that electrode is released so that the sorted material having been held attracted to that electrode is allowed to fall naturally, and differently electrified material contained in the sorted material separated and guided by first and second separating plates is attracted to an additional electrode, while the same effects as according to the fourth aspect of the present invention can be obtained.

In a friction electrifying-type electrostatic sorting apparatus according to a sixth aspect of the present invention, a swirl causing means causes a swirl of the sorted material in a transporting pipe while the sorted material is supplied therethrough so that the sorted material can be friction-electrified sufficiently before being supplied to a cyclone, while the same effects as according to the third aspect of the present invention can be obtained.

In a friction electrifying-type electrostatic sorting apparatus according to a seventh aspect of the present invention, at least one more feed roller and one more rotary electrode are provided on the downstream of the feed roller and rotary electrode described above to supply the sorted material which has not been sorted, and attract the sorted material electrified differently from the polarity of the applied voltage in the sorted material not sorted by the rotary electrode, while the same effects as according to the fourth aspect of the present invention can be obtained.

In a friction electrifying-type electrostatic sorting apparatus according to the present invention, a controller determines the air flow of a blower, the friction electrifying time of the friction electrifying unit, the voltage applied to and polarity of the rotary electrode, the inclination of the first and second separating plates and so forth according to preliminarily stored data in dependence on the kind of the sorted material and thus provides respective control signals, and a control mechanism controls the air flow of the blower, the friction electrifying time of the friction electrifying unit, the voltage applied to and polarity of the rotary electrode and the inclination of the first and second separating plates according to the control signals provided from the controller.

In a friction electrifying-type electrostatic sorting apparatus according to the present invention, a electrified state sensor provided in the friction electrifying unit detects the reaching of a predetermined electrified state of the sorted material, and upon reaching of the predetermined electrified state of the sorted material, the controller outputs a control signal to the feeding unit to let the sorted material in the predetermined electrified state be supplied to the feed roller, while the quantity of differently electrified material contained in the sorted material accommodated in an accommodation box is checked to output a signal to the controller.

In a friction electrifying-type electrostatic sorting apparatus according to the present invention, a shredding unit provided upstream finely shreds the sorted material, a screening unit screens the shredded sorted material for various sizes, an wind sorting unit sorts the screened material into heavy and light material by supplying an air stream at a predetermined speed, and the downstream friction electrifying-type electrostatic sorting unit sorts the sorted material suited for electrostatic sorting from the sorted materials.

In the friction electrifying-type electrostatic sorting apparatus according to the present invention, the sorted material is preliminarily electrified by providing a friction to a certain extent by the preliminary friction electrifying unit and then electrified by providing a friction uniformly by the friction electrifying unit for electrostatic sorting in the electrostatic sorting unit. It is thus possible to obtain highly accurate electrostatic sorting. Also, since the ratio of sorted material of one kind contained in the sorted material of the other kind is small, unlike the prior art, it is possible to meet a requirement of highly accurate sorting in a short period of time without need of passing the sorted material through the apparatus repeatedly.

In the friction electrifying-type electrostatic sorting apparatus according to the present invention, the sorted material containing a synthetic resin is preliminarily electrified during its transport with necessary friction provided by the lining of a material for promoting the electrifying of the sorted material, the lining being provided on the inner surface of the transporting pipe constituting the preliminary friction electrifying unit. Thus, it is possible to obtain an increased accuracy of electrostatic sorting compared to the first aspect of the present invention.

In the friction electrifying-type electrostatic sorting apparatus according to the present invention, the sorted material is electrified with necessary and sufficient friction provided by the inner walls of the transporting pipe, cyclone and reciprocal friction electrifying unit, which are lined with a material for promoting the electrifying of the sorted material. It is thus possible to the obtain practical electrostatic sorting of increased accuracy compared to the second aspect of the present invention.

In the friction electrifying-type electrostatic sorting apparatus according to the present invention, the feed roller supplies, with the rotation thereof, the sorted material having been electrified to a necessary and sufficient extent, the rotary electrode facing the feed roller and with a positive or negative voltage applied attracts the sorted material electrified differently from the polarity of the voltage applied to the rotary electrode, the first separating plate separates the differently electrified material in the electrostatic field, and the second separating plate separates the sorted material falling due to the own weight from the sorted material forcibly caused to fall by the friction. It is thus possible to obtain electrostatic sorting of high accuracy compared to the third aspect of the present invention.

In the friction electrifying-type electrostatic sorting apparatus according to the present invention, the electrode facing the feed roller attracts the sorted material electrified differently from the polarity of the applied voltage on the rotary electrode in the sorted material supplied by the friction, and with the rotation of the cylindrical member, the state of voltage application on the electrode is released, thus causing the sorted material that has been held attracted to the electrode surface is allowed to fall naturally. Thus, there is no need of the operation of removing the sorted material attracted to the electrode surface. Further, the differently electrified material that is introduced into the sorted material separated and guided by the first and second separating plates is substantially perfectly attracted to the additional electrode. It is thus possible to realize as high sorting accuracy as nearly 100 per cent.

In the friction electrifying-type electrostatic sorting apparatus according to the present invention, the a swirl causing means supplies the sorted material by causing a swirl thereof in the transporting pipe, thus causing substantial increase of the transporting distance to charge the sorted material by providing a friction sufficiently before the sorted material is supplied to the cyclone. It is thus possible to increase the amount of electrifying.

In the friction electrifying-type electrostatic sorting apparatus according to the present invention, at least one more downstream side additional feed roller supplies the sorted material containing material which has not been sorted by the upstream side rotary electrode, and the downstream side rotary electrode attracts introduced sorted material which has been electrified differently from the polarity of the applied voltage without being sorted by the upstream side rotary electrode. It is thus possible to further increase the accuracy of sorting.

In the friction electrifying-type electrostatic sorting apparatus according to the present invention, the air flow of the blower, the friction electrifying time of the friction electrifying unit, the voltage applied to and polarity of the rotary electrode and the inclination of the first and second separating plates are controlled to optimum value according to the control signals from the controller. It is thus possible to further increase the accuracy of sorting.

It the friction electrifying-type electrostatic sorting apparatus according to the present invention, when the electrifying state sensor detects the reaching of a predetermined electrified state of the sorted material, the controller outputs a control signal to the feeding unit to supply the sorted material in the predetermined electrified state to the feed roller. Thus, ideal electrostatic sorting is made possible, and also the accuracy of sorting can be greatly increased.

Further, the amount of differently electrified material introduced into the sorted material finally accommodated in the accommodation box, is checked for feedback control according to the result of the check. It is thus possible to further increase the accuracy of sorting.

In the friction electrifying-type electrostatic sorting apparatus according to the present invention, the shredding unit provided upstream finely shreds the sorted material, the screening unit screens the shredded sorted material for various sizes, the wind sorting unit sorts the sorted material having been screened by the screening unit to heavy sorted material and light one by supplying an air stream at a predetermined speed, and the downstream side friction electrifying-type electrostatic sorting unit sorts the sorted material suited for electrostatic sorting from the sorted sorted material. The sorted material is thus sorted by the optimum sorting method of air stream sorting and electrostatic sorting in dependence on the kind and size of the sorted material, and it is possible to greatly increase the accuracy of sorting.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

(First Embodiment)

Figure 1:
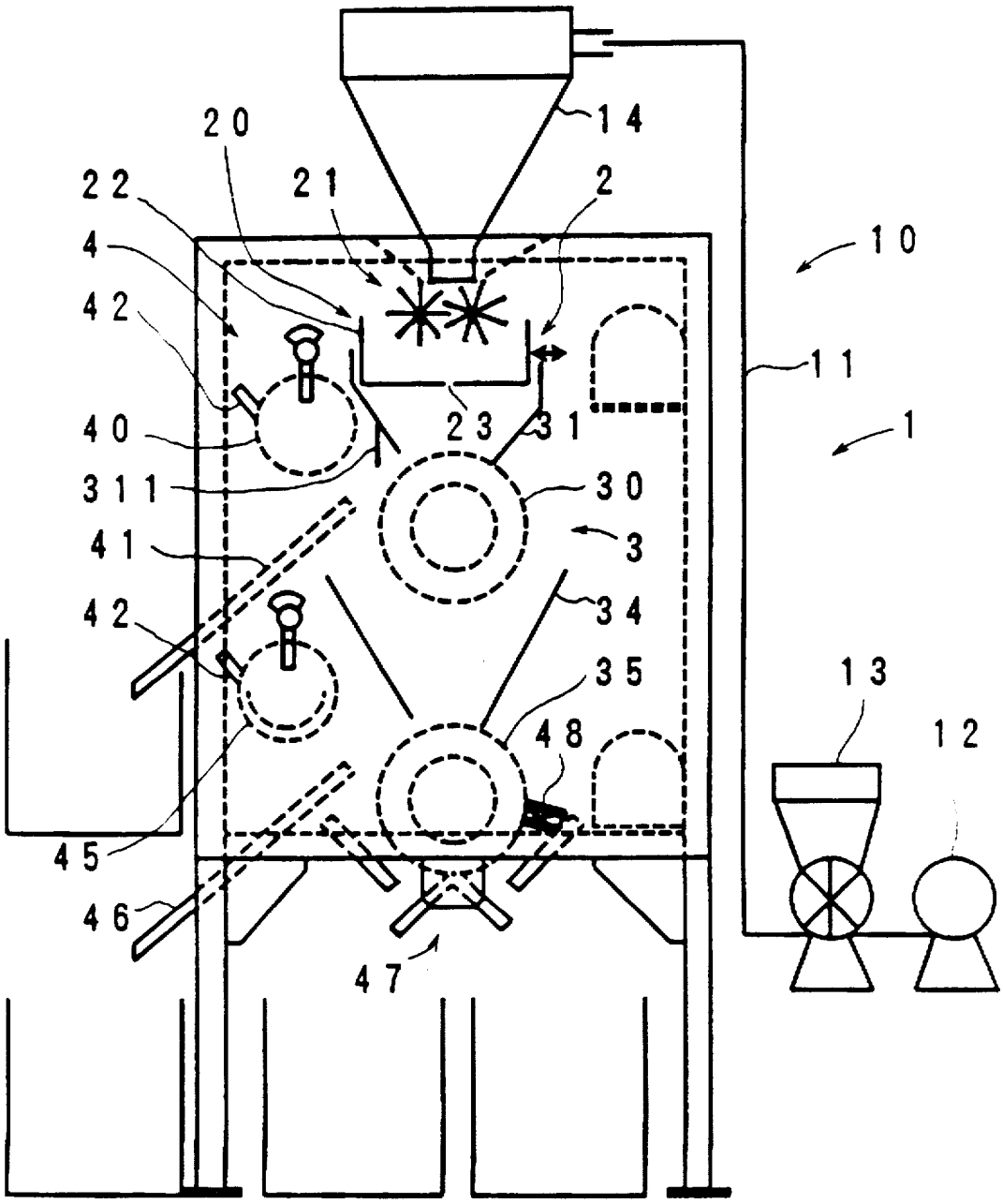
FIG. 1 is a side view showing an apparatus as a first embodiment of the present invention.
Figure 2:
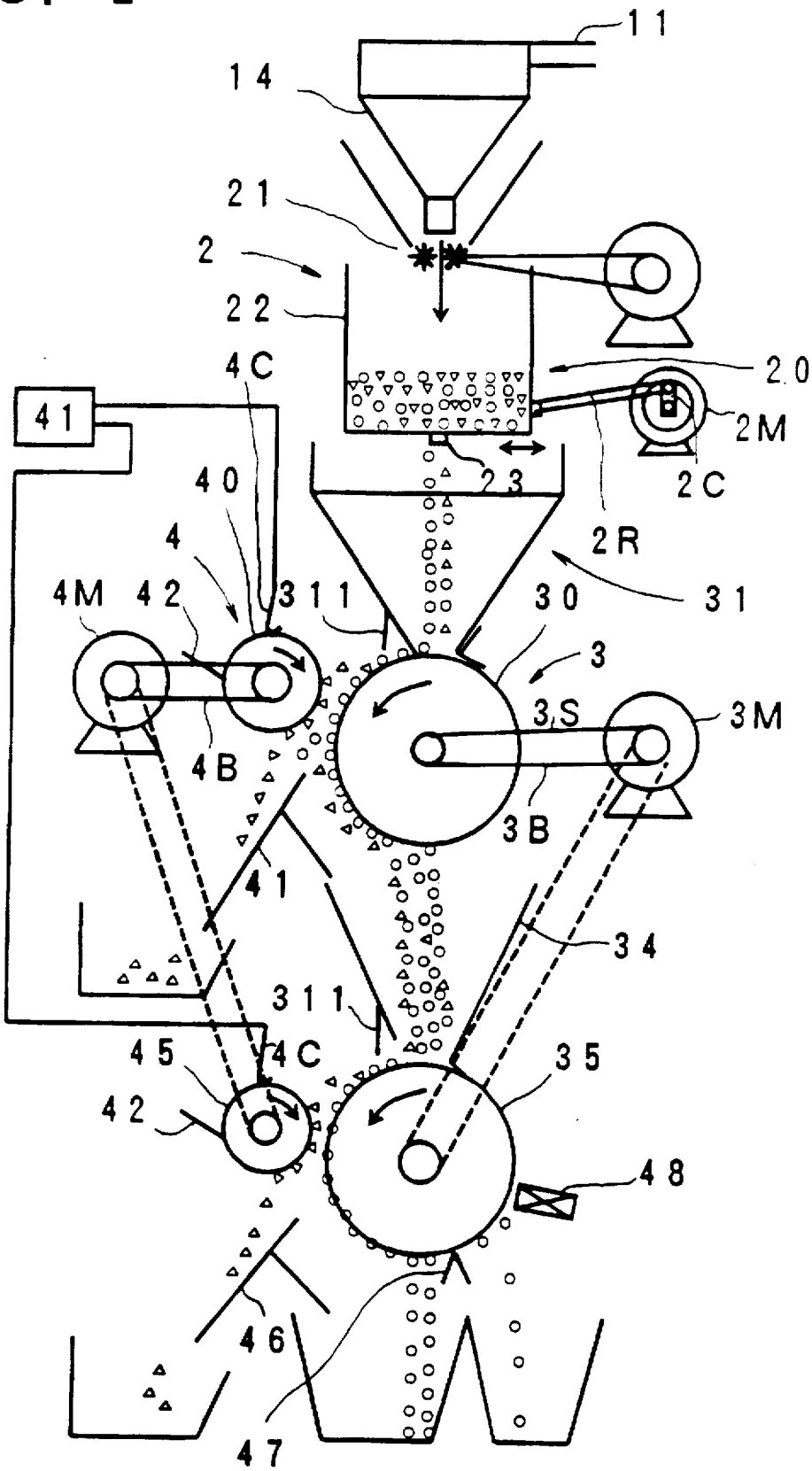
FIG. 2 is a view showing the principles of sorting underlying the apparatus as the first embodiment.
Figure 3:
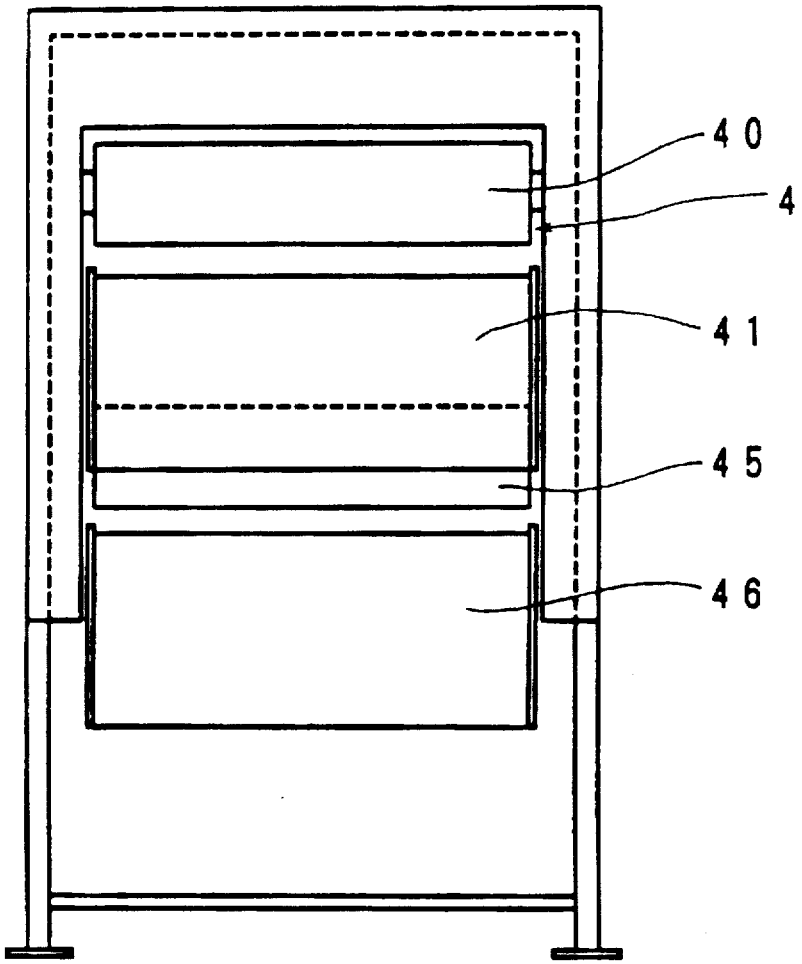
FIG. 3 is a front view showing the apparatus as the first embodiment.

FIGS. 1 to 3 show a first embodiment of a friction electrifying-type electrostatic sorting apparatus. As shown, the apparatus comprises a preliminary friction electrifying unit 1, a friction electrifying unit 2, a feeding unit 3 and an electrostatic sorting unit 4. The preliminary friction electrifying unit 1 is constituted by a transporting unit 10 having the inner surface thereof lined with a material for promoting the electrifying of sorted material containing a synthetic resin. In the transporting unit, the sorted material is transported while it is preliminarily electrified. The friction electrifying unit 2 is constituted by a reciprocal friction electrifying unit 20 having the inner surface thereof lined with a material for promoting the electrifying of sorted material. The feeding unit 3 is constituted by a feed roller 30 for supplying the sorted material having been electrified by the friction electrifying unit 2. The electrostatic sorting unit 4 is constituted by a rotary electrode 40 for sorting the electrified material supplied from the feeding unit 3 in a electrified state of the sorted material by providing an electrostatic field thereto.

The transporting unit 10 constituting the preliminary friction electrifying unit 1, as shown in FIG. 1, includes a transporting pipe 11, a turbo blower 12, a rotary feeder 13, and a conical cyclone 14. The transporting pipe 11 is lined with polyvinyl chloride as a electrifying material suited for the electrifying of sorted material containing a laminate of polyvinyl chloride and glass fibers. The transporting pipe 11 has a reinforcement coil made of a metal. The inner wall surface of the transporting pipe has smooth irregularities for promoting friction with the sorted material. The transporting pipe has a sufficient length. The turbo blower 12 forms an air stream in the transporting pipe 11 for transporting the sorted material with the air stream. The rotary feeder 13 serves to feed the sorted material into the transporting pipe 11. The transporting pipe 11 is tangentially open to the cyclone 14. The cyclone 14 has its inner wall surface lined with polyvinyl chloride as a material suited for the electrifying of the sorted material. The cyclone 14 feeds the sorted material helically to promote friction thereof with the inner wall. Thus, the cyclone charges the sorted material while tentatively storing the same.

The reciprocal friction electrifying unit 20 constituting the friction electrifying unit 2, as shown in FIGS. 1 and 2, is disposed beneath the cyclone 14. The sorted material falling from the cyclone 14 is weighed and supplied at a constant rate. The sorted material falls through between a pair of dispersing units 21, which are rotors having a star-like sectional profile and driven for rotation from a motor through a belt, thus causing dispersion of the sorted material in the reciprocal friction electrifying unit 20 in the width direction thereof. The sorted material from the dispersing units 21 enters a box 22 with the inner surface thereof lined likewise with polyvinyl chloride. The box 22 is connected through a connecting rod 2R to a crankshaft 2C driven for rotation by a motor 2M. Thus, with the rotation of the crankshaft 2C, the box 22 is reciprocated, thus electrifying the sorted material accommodated in the box 22 by providing friction. The sorted material thus electrified falls down through an opening 23.

The feed roller 30 constituting the feeding unit 3, as shown in FIGS. 1 and 2, has cotton cloth as insulating material incapable of electrifying provided on the outer periphery. The feed roller 30 is driven for rotation by a motor 3M through a belt 3B. The electrified material falling onto the feed roller 30, is guided by a pair of guide plates 31, which are arranged in a V-shaped fashion under an outlet opening 23 of the friction electrifying unit 2 as the sorted material is supplied to the electrostatic sorting unit 4.

One (i.e., forward one) of the pair of guide plates 31 in the V-shaped arrangement, forms a gap with respect to the feed roller 30 such that the sorted material can pass through the gap. A boot 311 is disposed such as to cover the gap. The electrified material falling through the opening 23 strikes and is flung back by the feed roller 30 to pass through the gap. The bolt 311 serves to stop the sorted material emerging through the gap, thus preventing the sorted material from being introduced into differently electrified material.

The rotary electrode 40 constituting the electrostatic sorting unit 4, as shown in FIGS. 1 and 2, is driven for rotation by a motor 4M through a belt 4B. The rotary electrode 40 is disposed slightly over the feed roller 30, and has a stainless steel outer periphery, to which the applied through contact means 4C a voltage, which is controlled by an applied voltage controlling unit 41 to a predetermined positive or negative voltage (for instance of 25,000 V although varying in dependence of the kind of the sorted material) and a current (for instance of the order of several milliamperes) in dependence of the kind of the sorted material. Thus, the rotary electrode 40 can attract and sort out the sorted material which has been electrified to the polarity differently (i.e., has the opposite polarity) from the polarity of the applied voltage on the rotary electrode among the electrified material supplied from the feed roller 30.

As shown in FIGS. 1 to 3, between the feed roller 30 and the rotary electrode 40, a separating plate 41 is disposed at a position and at an angle corresponding to the kind of the sorted material. In the electrostatic field noted above, the separating plate 41 can separate the differently electrified material attracted by the rotary electrode 40. The sorted material which has been electrified to the same polarity as and not attracted by the rotary electrode 40 is allowed to fall due to the own weight. The orbit of the sorted material being attracted to the rotary electrode 40 varies with the size, weight and shape of the sorted material and also with the applied voltage and current, i.e., commonly-termed electrostatic field, and the position and angle of the separating plate 41 is determined by taking the orbit into considerations.

A flexible removing plate 42 of a synthetic resin is disposed in contact with the outer periphery of the rotary electrode over the entire length thereof to rotary the sorted material which has been attracted to the rotary electrode 40 and attached to the outer periphery thereof.

In the first embodiment of the present invention, as shown in FIGS. 1 to 3, downstream the feed roller 30 and rotary electrode 40, at least one set of second feed roller 35 and second rotary electrode 45 is provided such hat the electrified material falling from the feed roller 30 is supplied by the pair of guide plates 34 provided in the V-shaped fashion below the feed roller 30 to the top of the second feed roller 35. As shown in FIGS. 1 to 3, a first separating plate 46 like that noted above is disposed between the second feed roller 35 and the second rotary electrode 45 to be able to separate the sorted material that has been electrified to the polarity differently from the polarity of the voltage applied to the second rotary electrode 45 in the electrostatic field from the sorted material falling onto the feed roller 30 without being attracted to the rotary electrode 40. In addition, an inverted V-shaped second separating plate 47, which supplies the sorted material having been electrified to the same polarity as and not attracted by the second rotary electrode 45 along the outer periphery of the second feed roller 35 to be allowed to fall due to the own weight, is disposed below the second feed roller 35. The sorted material which has been attached to the second feed roller 35, is removed with magnetic force of repulsion and allowed to fall by providing magnetic repelling means 48 constituting second separating means of the same polarity as that of the sorted material supplied along the feed roller 45.

In the first embodiment of the friction electrifying-type electrostatic electrifying apparatus having the above construction, as shown in FIG. 1, the turbo blower 12 forms an air stream for feeding the sorted material by air feeding into the transporting pipe 11 of the transporting unit 10 constituting the preliminary friction electrifying unit 1. When the rotary feeder 13 charges the sorted material as a laminate of polyvinyl chloride and glass fibers into the transporting pipe 11, the transporting pipe 11, which has a sufficient length, is lined with polyvinyl chloride as a electrifying material suited for the electrifying of the sorted material, includes the reinforcement coil made of a metal and has the inner wall surface formed with smooth irregularities, preliminarily charges the sorted material by promoting friction thereof with the lining. Besides, the sorted material is supplied helically through the conical cyclone 14, to which the transporting pipe 11 is open tangentially, and which has its inner wall surface lined with polyvinyl chloride as a electrifying material suited for the electrifying of the sorted material. The sorted material thus can be effectively preliminarily electrified in a sufficient period of time, with sufficient centrifugal force and with effective promotion of friction with the inner wall surface noted above In the reciprocal friction electrifying unit 20 constituting the friction electrifying unit 2, as shown in FIGS. 1 and 2, the sorted material falling from the cyclone 14 is weighed by the dispersing unit 21 formed by the pair of rotors having the star-like sectional profile and dispersed in the width direction of the reciprocal friction electrifying unit 20 to be supplied to the box 22 with the inner surface thereof lined with polyvinyl chloride as noted above. As the box 22 is reciprocated with the rotation of crankshaft driven by the motor, the sorted material falling to be accommodated in the box 22 is electrified sufficiently by providing a friction before being allowed to fall through the opening 23.

The feed roller 30 constituting the feeding unit 3 supplies the sufficiently electrified material falling onto the feed roller with the pair of guide plates 31 providing in a V-shaped fashion beneath the outlet opening 23 of the friction electrifying unit 2, the sorted material being thus supplied along the outer periphery of the feed roller 30 to the electrostatic sorting unit 4.

The rotary electrode 40 of the electrostatic sorting unit 4 is disposed slightly above the feed roller 30. The rotary electrode has a stainless steel outer periphery, to which is applied through contact means 4C a voltage controlled by the applied voltage controller 41 in dependence on the kind of the sorted material to predetermined positive or negative voltage (for instance −25,000V in the first embodiment) and current (in the order of several milliamperes). For example, the rotary electrode attracts and sorts out glass fibers as sorted material, which has been electrified to the polarity differently (i.e., of the opposite polarity) from the polarity of the applied voltage to the rotary electrode, from the electrified material supplied along the outer periphery of the feed roller 30.

The separating plate 41 is disposed between the feed roller 30 and the rotary electrode 40 and at a position corresponding to the kind of the sorted material, separates and guides glass fibers as the differently electrified material attracted by the rotary electrode 40 in the electrostatic field. Polyvinyl chloride as sorted material electrified to the same polarity as the rotary electrode 40, having been not attracted to the rotary electrode 40, is allowed to fall naturally due to the own weight.

Polyvinyl chloride as electrified material, which has fallen from the feed roller 30 and contains glass fibers as differently electrified material not attracted to the electrostatic sorting unit 4, is supplied by the pair of guide plates 34 disposed in the V-shaped arrangement beneath the feed roller 30 to the top of the second feed roller 35 to be led along the outer periphery thereof.

The second rotary electrode 45 attracts glass fiber as the sorted material which has been electrified to the polarity differently from the polarity of the applied voltage in the electrostatic field from the sorted material falling from the feed roller 30 without being partly attracted by the rotary electrode 40, and the first separating plate 46 disposed between the second feed roller 35 and the rotary electrode 45, separates differently electrified material which has been attracted.

The polyvinyl chloride as the electrified material not attracted to the second rotary electrode 45, is supplied along the outer periphery of the second feed roller 45. The sorted material naturally falling due to the own weight is separated and guided by the second separating plate 47 neat the lowermost point. Further, the sorted material which has been attached to the second feed roller 45 and is moving upward with the same, is removed and allowed to fall by magnetic repulsion force of magnetic repelling means 48 which constitutes second separating means of the same polarity as the sorted material.

In the first embodiment of the friction electrifying-type electrostatic sorting apparatus having the above functions, the sorted material is preliminarily electrified to a certain extent with friction provided by polyvinyl chloride lining provided on the inner surface of the transporting pipe 11 and cyclone 14 constituting the preliminary friction electrifying unit 1, and then electrified uniformly with friction provided by the reciprocal friction electrifying unit 20 constituting the friction electrifying unit 2, before the sorted material is subjected to electrostatic sorting by the rotary electrode 40 constituting the electrostatic sorting unit. Thus, it is possible to obtain highly accurate electrostatic sorting. In addition, since the sorted material of the other kind is less introduced into the sorted material of one kind, unlike the prior art, it is possible to carry out sorting of high accuracy, if required, without need of passing the sorted material through the apparatus repeatedly. The sorting thus can be carried out in a short period of time.

Further, in the first embodiment of the friction electrifying-type electrostatic sorting apparatus, the polyvinyl chloride lining provided on the inner surface of the transporting pipe 1 constituting the preliminary friction electrifying unit, promotes the electrifying of the sorted material containing a synthetic resin. The friction of the sorted material is further promoted by the provision of the reinforcement coil made of a metal and also of smooth irregularities formed on the inner surface. Further, the transporting pipe 11 has a sufficient length to ensure sufficient distance and time for frictional electrifying. Thus, the sorted material can be preliminarily electrified by providing necessary friction during its transport. It is thus possible to obtain higher accuracy electrostatic sorting.

Further, in the first embodiment of the friction electrifying-type electrostatic sorting apparatus, with the inner walls of the transporting pipe 11, cyclone 14 and reciprocal friction electrifying unit 20 having the aforementioned lining of polyvinyl chloride as material for promoting the electrifying of sorted material containing a synthetic resin, the sorted material thus can be given necessary and sufficient friction for electrifying. Thus, it is possible to obtain higher accuracy electrostatic sorting of glass fibers and polyvinyl fibers as sorted materials. Further, because of less content of the sorted material of the other kind in that of one kind, unlike the prior art, high accuracy sorting, when required, can be made without need of passing the sorted material through the apparatus repeatedly. The sorting thus can be made in a short period of time.

Furthermore, in the first embodiment of the friction electrifying-type electrostatic sorting apparatus, the feed roller 30 supplies the necessarily and sufficiently electrified material with its rotation. Further, the rotary electrode 40 facing the feed roller 30 an electrified positively or negatively in dependence on the sorted material, attracts the sorted material which has been electrified to the polarity differently from the polarity of the voltage applied to the rotary electrode 40. Further, the separating plates 41 and 46 separates the differently electrified material in the electrostatic field and guides the separated sorted material to the outside. Further, the second separating plate 47 separates the sorted material falling due to the own weight. Further, the magnetic repelling means 48 constituting the second separating means provides magnetic repulsion force to separate the sorted material remaining attached to the feed roller 35 (i.e., material not falling due to the own weight). It is thus possible to sort the sorted material into three different sorted materials. Further, it is possible to permit recycling of synthetic resin.

Moreover, in the first embodiment of the friction electrifying-type electrostatic sorting apparatus, two stages, i.e., upstream and downstream stages, of feed rollers and rotary electrodes, are provided. specifically, the downstream feed roller supplies the sorted material containing part of the material which has not been sorted by the upstream rotary electrode. Further, the downstream rotary electrode attracts the differently electrified material contained without being sorted by the upstream rotary electrode. Thus, it is possible to further increase the accuracy of sorting.

(Second Embodiment)

Figure 4:
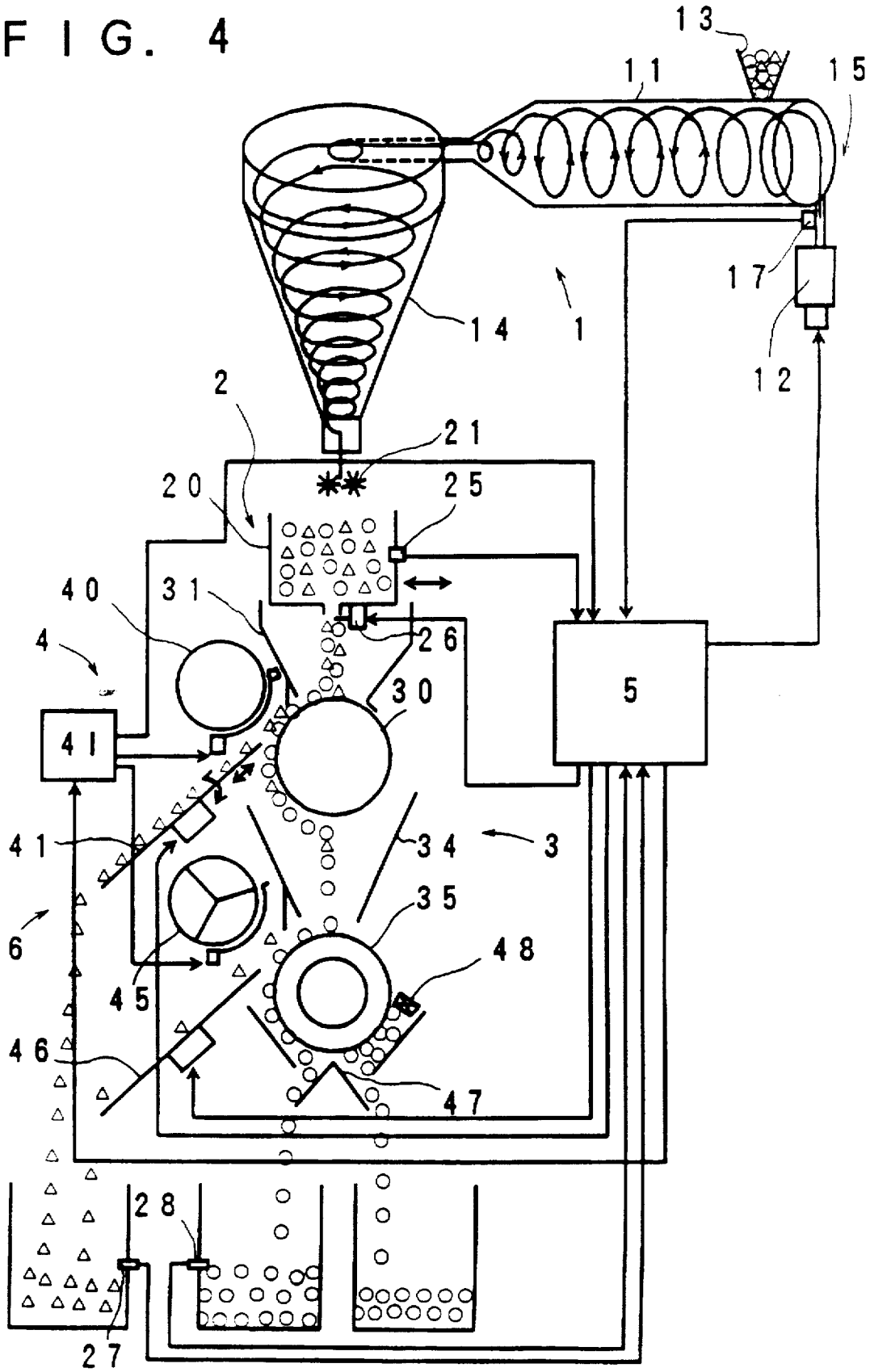
FIG. 4 is a view showing the basic structure of an apparatus as a second embodiment of the present invention.
Figure 5:
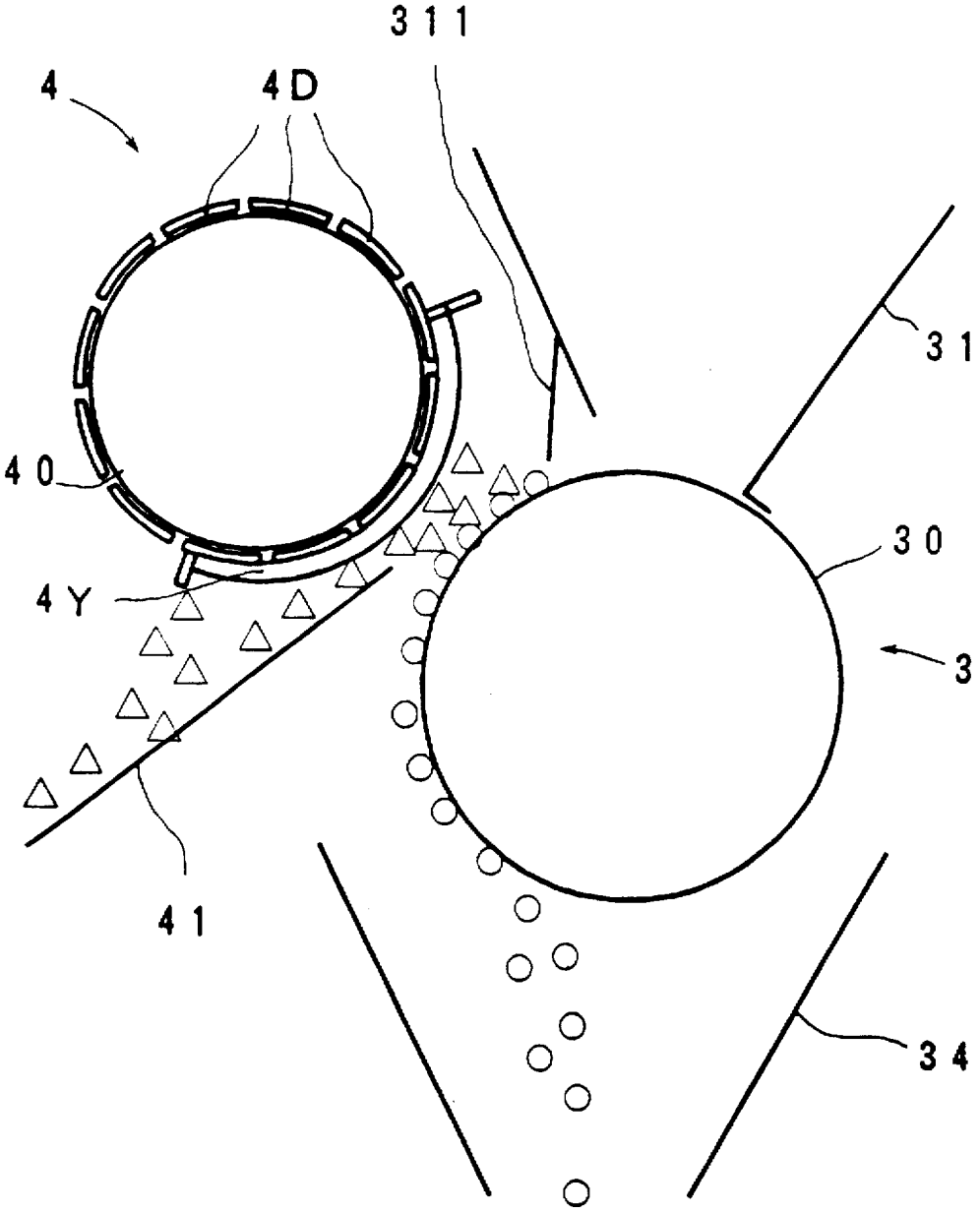
FIG. 5 is a fragmentary enlarged-scale view illustrating the principles of sorting in the apparatus as the second embodiment.

A second embodiment of the friction electrifying-type electrostatic sorting apparatus is shown in FIGS. 4 and 5. In this embodiment, an air stream from the turbo blower 12 is supplied tangentially into the transporting pipe 11 to produce a whirl in the pipe 11. Whirling causing means 15 is thus constituted by the transporting pipe 11. Whirling of the sorted material which contains a laminate of polyvinyl chloride and polyethylene telephthalate, is thus caused during transportation of the sorted material to sufficiently charge the same by providing a friction before the sorted material is supplied to the cyclone 14. Further, the rotary electrodes 40 and 45 are each constituted by a plurality of divided electrodes 4D provided on the outer periphery of a cylindrical member rotated in synchronism with the feed roller. Voltage is applied to only the division electrode which faces each of the feed rollers 30 and 33 connected to applied voltage control means 41 in a contact relation to an arcuate contact 4Y which is disposed such that it faces each of the feed rollers 30 and 35. The above arrangements constitute the difference of this second embodiment from the preceding first embodiment.

Further, in the second embodiment, an air flow sensor 17 for detecting the air flow from the turbo blower 12, a electrified state sensor 25 provided in the friction electrifying unit 2 to detect the reaching of a predetermined electrified state of the sorted material, throttling means 26 disposed in the outlet opening of the friction electrifying unit to control the opening area, and electrified state sensors 27 and 28 each provided in an accommodation box for accommodating the sorted material, are added to the first embodiment.

In the second embodiment, a controller 5 is further added to the first embodiment. In the controller 5 are stored data about the air flow of the blower, the friction electrifying time of the friction electrifying unit, the voltage applied to and polarity of the rotary electrodes, the inclination of the first and second separating plates and so forth, these data being obtained empirically in dependence on the kind of the sorted material. When a predetermined electrified state of the sorted material is reached, the controller 5 outputs signal for opening the outlet opening of the friction electrifying unit, a signal for elevating the sorting accuracy obtained from the consideration of the degree of intrusion of the differently electrified material by detecting the electrified state of the sorted material accommodated in the accommodation box, and other control signals according to the stored data and also to detection data from the various sensors. Further, various control mechanisms 6 are added to the first embodiment, which control the air flow of the blower, the friction electrifying time of the friction electrifying unit, the voltage applied to and polarity of the rotary electrodes, and the inclination of the first and second separating plates according to the control signals from the controller 5.

As for the control signals noted above, the correlation and optimum values of the sorting accuracy, air flow of the blower, friction electrifying time, electrified state, voltage applied to and polarity of the rotary electrodes 40 and 45 and position and inclination of the separating plates are obtained in advance from experiments, and these data are stored in a memory of the controller 5. The controller 5 determines the control signals according to the stored data.

In the second embodiment of the friction electrifying-type electrostatic sorting apparatus having the above construction, the swirl causing means 15 from a swirl in the transporting pipe 11 to cause a swirl of the sorted material during transportation thereof. It is this possible to realize a transportation distance longer than that actual length of the transporting pipe 11 in the longitudinal direction. It is thus possible to ma e full use of the transporting pipe 11. In addition, a centrifugal force is exerted to the sorted material to realize a state of strong contact with the lining, so that the sorted material can be electrified by providing a friction sufficiently before being supplied to the cyclone 14.

In the second embodiment of the friction electrifying-type electrostatic sorting apparatus, the controller 5 outputs the individual control signals by determining the air flow of the turbo blower 12, friction electrifying time of the friction electrifying unit 2, voltage applied to and polarity of the rotary electrode 4, inclination of the first and second separately plates 41, 46 and 48 or the like according to the Stored data and output signals of the sensors in dependence on the kind of the sorted material. In addition, the individual control mechanisms 6 control the air flow of the blower, friction electrifying time of the friction electrifying unit 2, voltage applied to and polarity of the rotary electrode 4 and inclination of the first and second separating plates 41, 46 and 48 according to the control signals from the controller 5.

Further, in the second embodiment of the friction electrifying-type electrostatic sorting apparatus, among a large number of divided electrodes 4D provided on the outer periphery of each of the rotary electrodes 40 and 45, only those which face the feed rollers 30 and 35 receive applied voltage in dependence on the contact relation to the arcuate contact 4Y, thus attracting the sorted material which has been electrified to the polarity differently from the applied voltage on the electrodes from the sorted material supplied by the feed rollers 30 and 35. With the rotation of the rotary electrodes 40 and 45, the contact relation to the arcuate contact 4Y is released to release voltage application to the electrodes, thus allowing the sorted material having been attached to the electrode surface to fall naturally.

Further, in the second embodiment of the friction electrifying-type electrostatic sorting apparatus, the electrified state sensor 25 provided in the friction electrifying unit 2 detects the reaching of a predetermined electrified state of the sorted material. When the predetermined electrified state of the sorted material is reached, the controller 5 outputs a control signal to the control mechanisms to open the outlet opening, whereby the sorted material in the predetermined electrified state is supplied to the feed roller 30.

Further, the electrified state sensors 27 and 28 provided in the accommodation box detect the amount and ratio of laminate of the different material for feedback control of the air flow of the turbo blower 12, friction electrifying time of the friction electrifying unit 2, voltage applied to and polarity of the rotary electrode 4, in lination of the first and second separating plates 41, 46 and 48 or the like.

Further, in the second embodiment of the friction electrifying-type electrostatic sorting apparatus having the above functions, the electrode which faces the feed roller 30 attracts the sorted material having been electrified to the polarity differently from the polarity of its applied voltage that is contained in the sorted material supplied from the feed roller 30. Further, with the rotation of the rotary electrode 40, the voltage application state of the electrode is released, thus allowing the sorted material having been attached to the electrode surface to fall naturally.

Thus, there is no need of operation of removing the sorted material attached to the electrode surface.

Further, in the second embodiment of the friction electrifying-type electrostatic sorting apparatus, the swirl causing means 15 causes the sorted material to be carried with the swirl formed in the transporting pipe 11. Thus, the transport distance is increased in effect, while a centrifugal force is exerted to the sorted material. The sorted material is thus electrified sufficiently by friction with the lining provided on the inner surface of the transporting pipe before it is supplied to the cyclone 14. It is thus possible to increase the extent of electrifying, thus permitting more reliable electrostatic sorting of polyvinyl chloride and polyethylene terephthalate noted above.

Further, in the second embodiment of the friction electrifying-type electrostatic sorting apparatus, the air flow of the blower, friction electrifying time of the friction electrifying unit, voltage applied to and polarity of the rotary electrode and position and inclination of the first and second separating plates are controlled as optimum control according to the control signals from the controller 5 in dependence on the sorting behavior of the sorted material noted above (i.e., the orbit of the sorted material attracted by the rotary electrode 40). It is thus possible to further increase the accuracy of sorting.

Further, in the second embodiment of the friction electrifying-type electrostatic sorting apparatus, upon detection of the predetermined electrified state of the sorted material by the electrified state sensor 25, the controller 5 outputs a control signal to the throttling means 26, causing the throttling means 26 to open the outlet opening of the friction electrifying unit 2 to supply the sorted material in a electrified state suited to the electrostatic sorting to the feed roller 30 while effecting feedback control according to the amount or ratio of material contained in the sorted material. Thus, ideal electrostatic sorting is made possible, and the sorting accuracy can be greatly increased.

(Third Embodiment)

Figure 6:
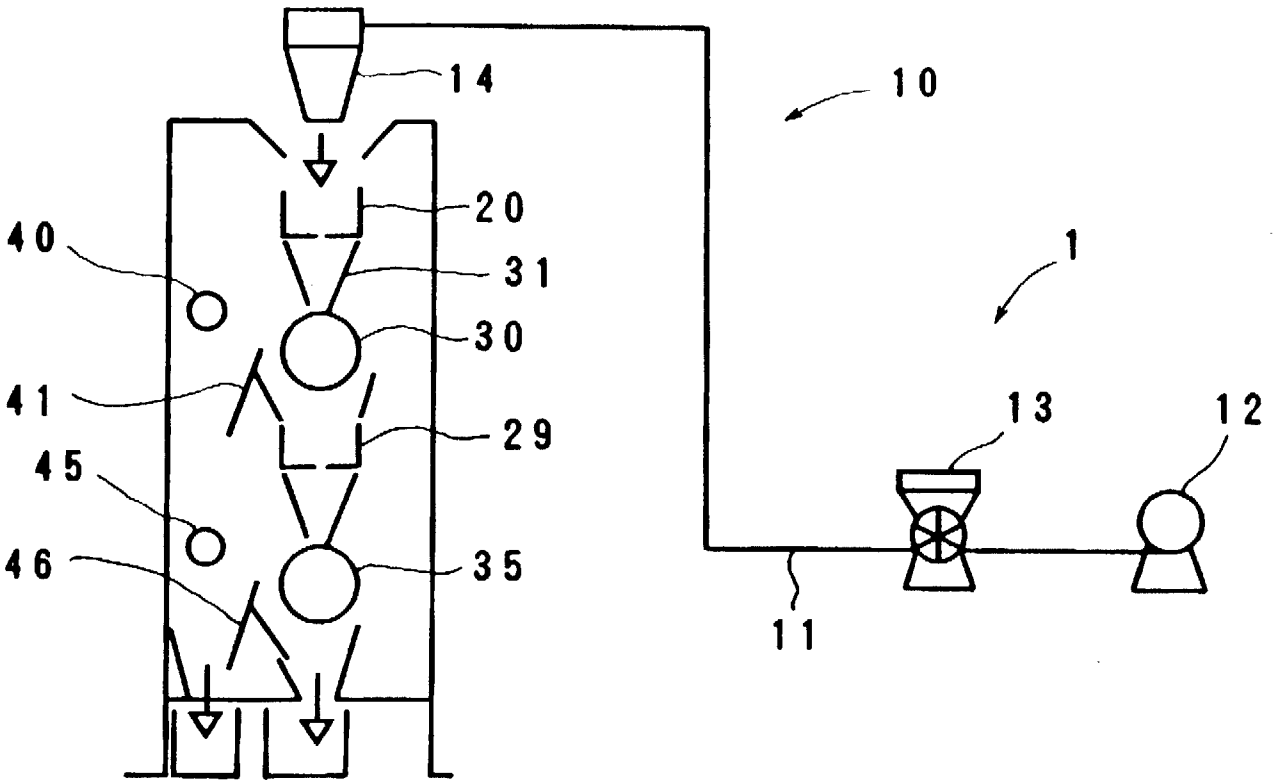
FIG. 6 is a side view showing an apparatus as a third embodiment of the present invention.

A third embodiment of the friction electrifying-type electrostatic sorting apparatus is shown in FIG. 6. The third embodiment is mainly different from the first embodiment in that a second friction electrifying unit 29 is additionally provided between the feed rollers 30 and 35. The sorted material containing the differently electrified material which has not been attracted by the rotary electrode 40 is sufficiently electrified by friction by reciprocating the sorted material again by the second friction electrifying unit 29. The sorted mater al is thus supplied to the downstream feed roller 35 and rotary electrode 45 to permit accurately electrostatic sorting of the differently electrified material from the sorted material containing the differently electrified material.

In the third embodiment of the friction electrifying-type electrostatic sorting apparatus, the sorted material containing the differently electrified material due to the defective electrified state is sufficiently electrified by friction by reciprocating the sorted material again by the second friction electrifying unit 29. It is thus possible to elevate further sorting accuracy in comparison with that of the preceding first embodiment.

(Fourth Embodiment)

Figure 7:
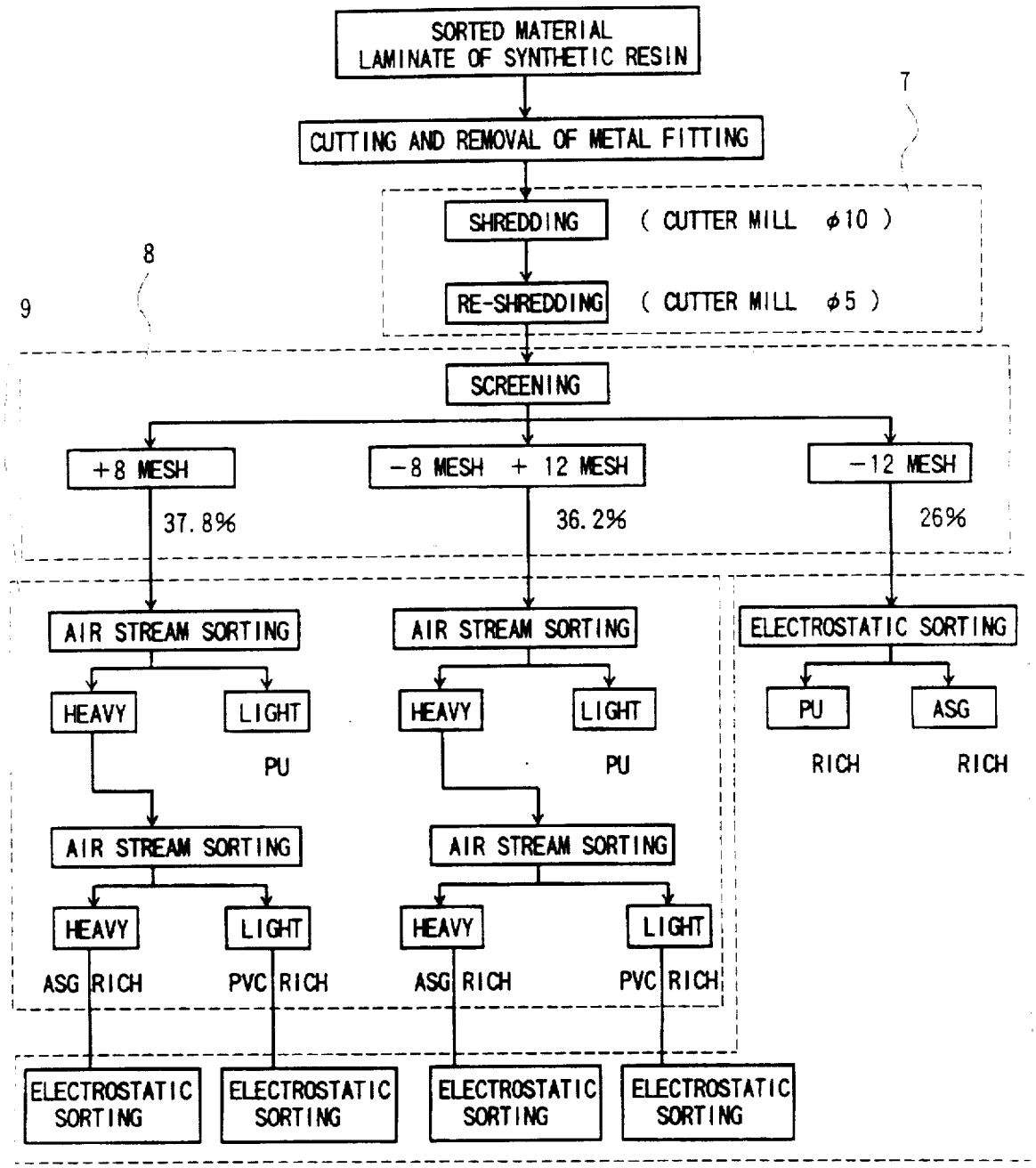
FIG. 7 is a view showing the flow of sorting in a fourth embodiment of the present invention.

A fourth embodiment of the friction electrifying-type electrostatic sorting apparatus is shown in FIG. 7. In this embodiment, additional components are a shredding unit 7, a screening unit 8, and an air stream sorting unit 9. The shredding unit 7 finely shreds the sorted material which is a laminate of different synthetic resins such as polyurethane, acrylonitrile-styrene and polyvinyl chloride. The screening unit 8 screens the sorted material shredded by the shredding unit 7 for various sizes. The air stream sorting unit 9 sorts the sorted material screened by the screening unit 8 into heavy sorted material and light one by supplying an air stream at a predetermined speed. The sorted material is thus sorted in advance by air stream sorting prior to the electrostatic sorting.

The shredding unit 7 coarsely shreds and re-sheds the sorted material with at least one cutter mill of 5, 8 and 10 o/.

The screening unit 8 screens the sorted material coarsely shredded and re-shredded by the shredding unit 7 for three different sizes, for instance 8, 10 and 12 mesh sizes.

The air stream sorting unit 9 shorts the sorted material, which has been screened by the screening unit 8 for, for instance, 8 and 10 mesh sizes, into heavy and light sorted materials with air stream. The sorted heavy sorted material is further sorted with air steam into heavy and light sorted materials. These sorted sorted materials, like that of 12 mesh size noted above, are electrostatically sorted in a electrified state in a friction electrifying type electrostatic sorting apparatus like the first embodiment of the apparatus.

In the fourth embodiment of the friction electrifying-type electrostatic sorting apparatus, the cutter mill of the shredding unit 7 as the additional component finely shreds the sorted material, the screening unit 8 screens the sorted material shredded by the shredding unit 7 for 8 and 12 mesh sizes, and the air stream sorting unit 9 sorts the sorted material screened by the screening unit 8 into heavy and light sorted materials by supplying an air stream at a predetermined speed. A comparatively heavy sorted material suited for electrostatic sorting, as selected from among the shorted sorted materials, is electrostatically sorted in a electrified state in the downstream friction electrifying-type electrostatic sorting apparatus.

In the fourth embodiment of the friction electrifying-type electrostatic sorting apparatus, as show in FIG. 7, the upstream shredding unit 7 as the additional component finely shreds the sorted material, the screening unit 8 screens the sorted material shredded by the shredding unit 7 for various sizes, and the air stream sorting unit 8 sorts the sorted material sorted by the sorting unit 8 into heavy and light sorted materials by supplying an air stream at a predetermined speed. The sorted material which is selected from among the sorted sorted materials and suited for electrostatic sorting is sorted in the downstream friction electrifying-type electrostatic sorting apparatus. The sorted material is thus sorted by an optimum sorting process of air stream sorting and electrostatic sorting in dependence on its kind and size. It is thus possible to greatly increase the accuracy of sorting and permit sorting of a sorted material which is a laminate of different synthetic resins.

(Fifth Embodiment)

Figure 8:
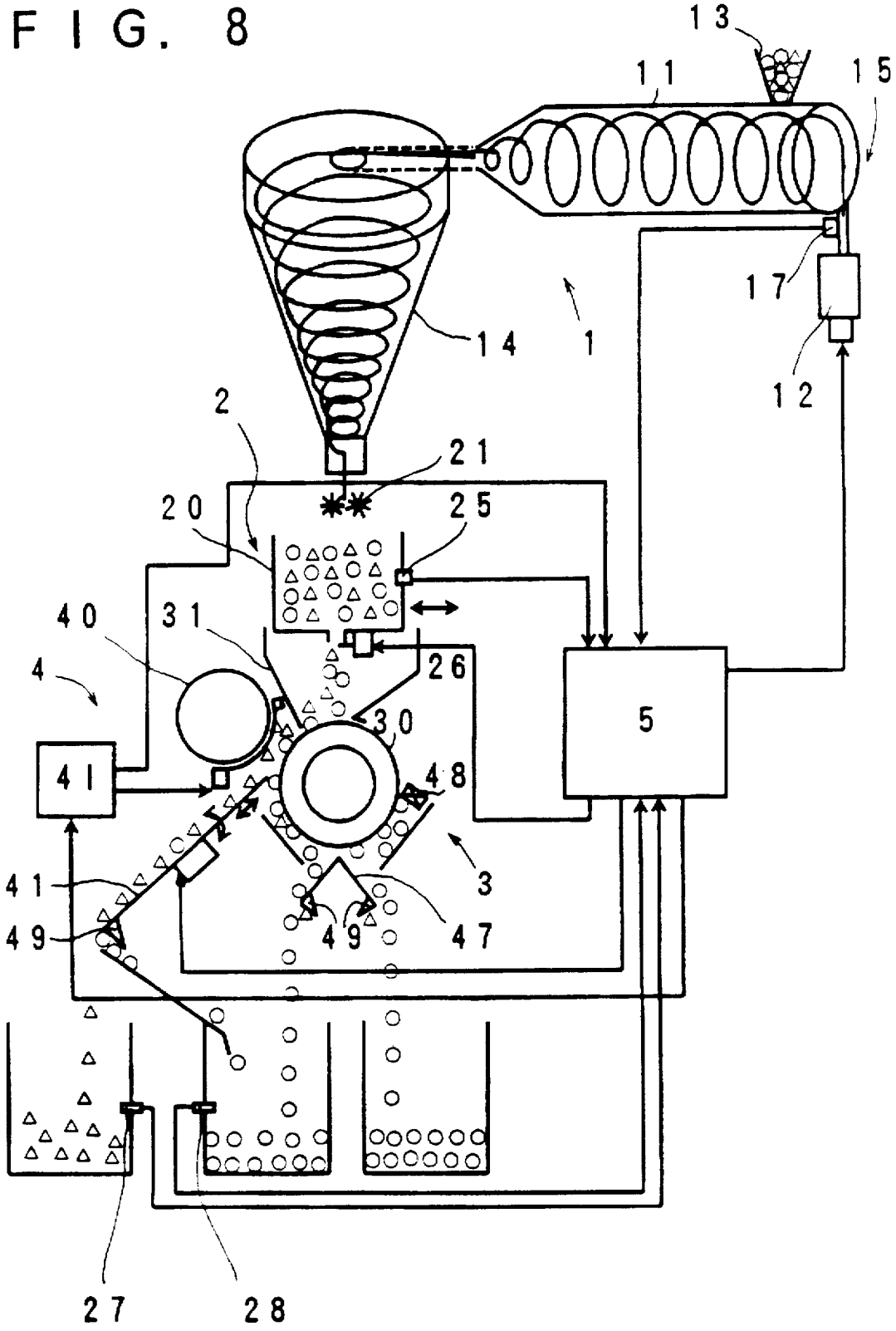
FIG. 8 is a fragmentary enlarged-scale view showing an apparatus as a fifth embodiment of the present invention.

A fifth embodiment of the friction electrifying-type electrostatic sorting apparatus is shown in FIG. 8. In this embodiment, the downstream feed roller 35 and rotary electrode 45 in the second embodiment are removed, that is, only the upstream feed roller 30 and rotary electrode 40 are provided. Further, additional electrodes 49 are provided at the lower end of the separating plates 41, 46 and 47, which guide the sorted material, i.e., acrylonitrile-butadiene-styrene copolymer and polyvinyl chloride sorted by the electrostatic sorting. To the additional electrodes 49 is applied a voltage of the same polarity as that of the guide sorted material, i.e., of the polarity opposite to that of the contained differently electrified material.

In the fifth embodiment of the friction electrifying-type electrostatic sorting apparatus having the above constitution, the sorted and guided sorted material, guided by the separating plates 41, 46 and 47, is allowed to fall naturally without being attracted because it is of the same polarity as the additional electrodes 49. On the other hand, the differently electrified material that is contained is entirely attracted to the additional electrodes 49 so that it will not fall into the accommodation box disposed below. It is thus possible to greatly increase the accuracy of sorting to ensure as high sorting accuracy as nearly 100 per cent.

Further, since the fifth embodiment of the friction electrifying-type electrostatic sorting apparatus employs only a single set of feed roller 30 and rotary electrode 40, its structure is simplified, its maintenance is readily made, and cost reduction can be obtained.

While some preferred embodiments of the invention have been shown and described, they are by no means limitative, and various changes, modifications and additions are possible without departing from the technical concept of the invention as recognized by one having ordinary knowledge in the art from the claims, detailed description of the invention and drawings.

Figure 9:
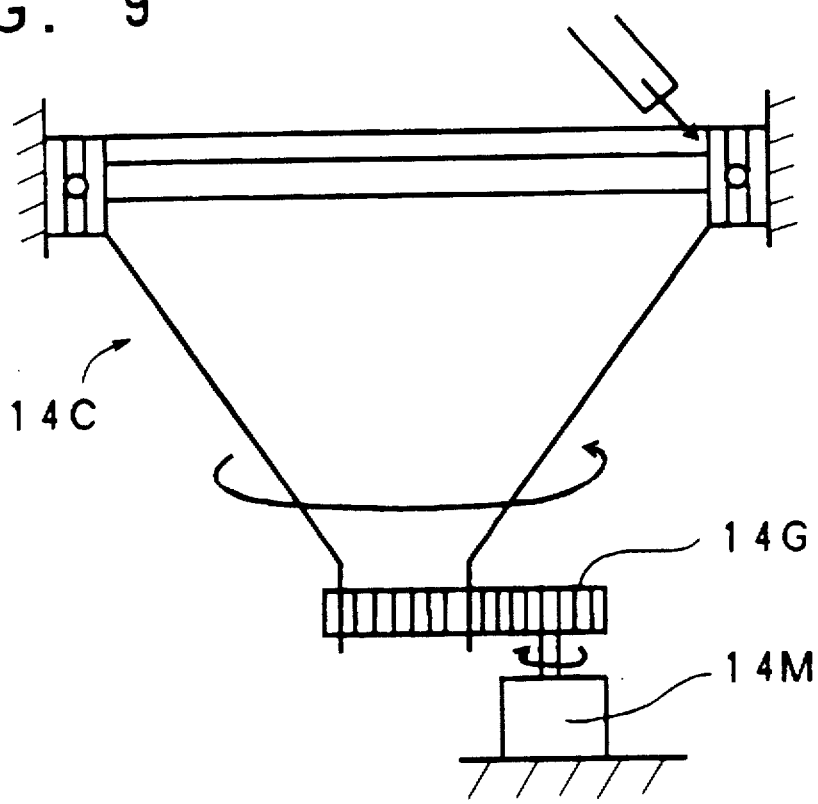
FIG. 9 is a view showing a modification of a cyclone.

For example, while the above embodiments employed a stationary cyclone, this is not limitative, and as shown in FIG. 9, a conical cyclone 14C itself may be rotated by a motor 14M through a gear 14G to provide a centrifugal force to the sorted material for intense friction electrifying thereof.

Figure 10:
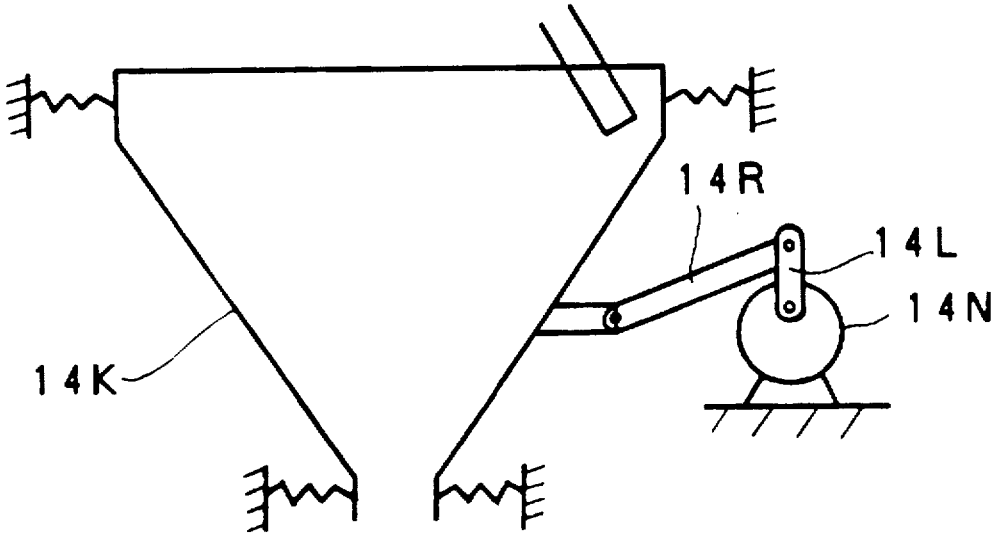
FIG. 10 is a view showing another modification of a cyclone.

Alternatively, as shown in FIG. 10, a pyramidal cyclone 14K may be given elliptical motion by a motor 14N through a crankshaft 14L and a connecting rod 14R to provide for intense friction electrifying. Further, it is possible provide the cyclone with the function of the friction electrifying unit, thus dispersing with the independent friction electrifying unit.

Figure 11:
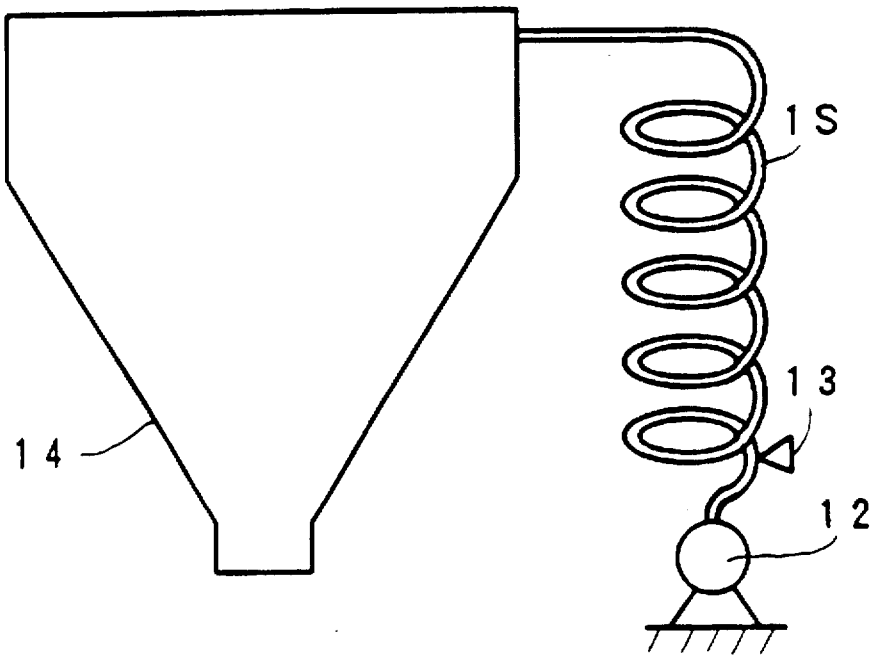
FIG. 11 is a view showing a modification of a transporting pipe.

Further, while it has been described that a swirl is formed in the transporting pipe 11 to transport the sorted material with the swirl, this is by no means limitative. For example, as shown in FIG. 11, it is possible to use a helical transporting pipe 1s to provide a long effective distance of transport and friction provision in a narrow space while providing a centrifugal force to the sorted material, thus permitting sufficient electrifying thereof by providing a friction.

Figure 12:
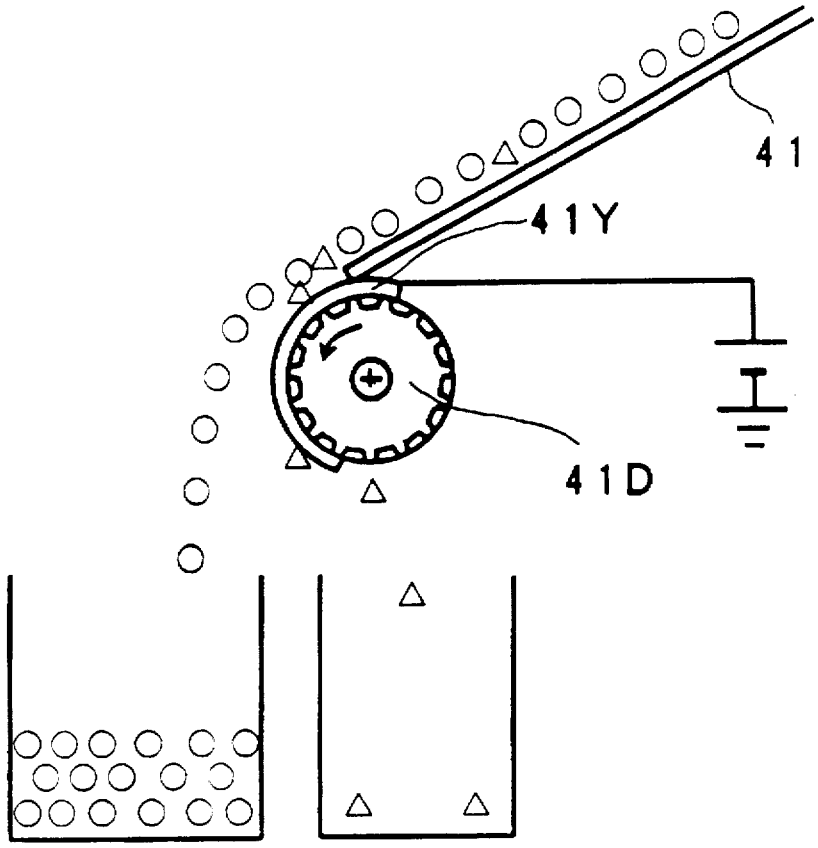
FIG. 12 is a view showing a modification of an additional electrode.

Further, while in the fifth embodiment the additional electrode are provided at the end of the separating plates, this is not limitative. For example, it is possible to adopt an arrangement as shown in FIG. 12. As shown, at the lower end of the separating plate 41, a rotary electrode is provided, which comprises a plurality of divided electrodes 41D and an arcuate contact 41Y like that in the second embodiment. With this arrangement, the attracted material is allowed to fall automatically in an electrode portion free from the contact 41Y (i.e., lowermost portion in the Figure).

Further, while in the fifth embodiment, the additional electrodes are provided on both of the first and second separating plates, it is possible to adopt a mode of providing the additional electrode only for materials, in which intrusion of differently electrified materials is not allowed.

Figure 13:
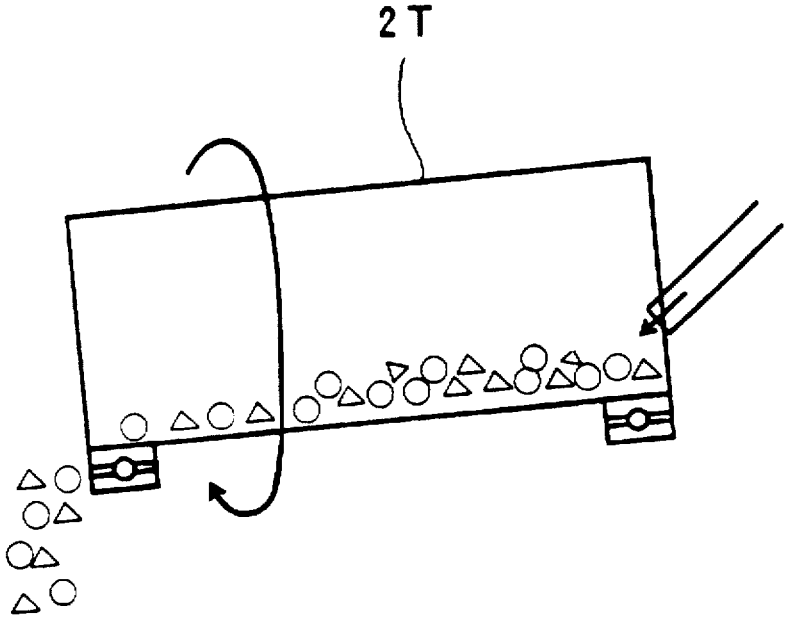
FIG. 13 is a view showing a modification of a friction electrifying unit.

Further, while the above embodiments employs the reciprocal friction electrifying unit as the friction electrifying unit, this is by no means limitative. For example, it is possible to use a hollow cylindrical trammel 2T as shown in FIG. 13, which has its inner surface provided with a lining like that described, is disposed in an inclined fashion, is rotated and has a predetermined length. In this structure, as the sorted material is gradually moved axially through the trammel 2T, it is electrified with friction provided by the rotation of the trammel 2T.

Figure 14:
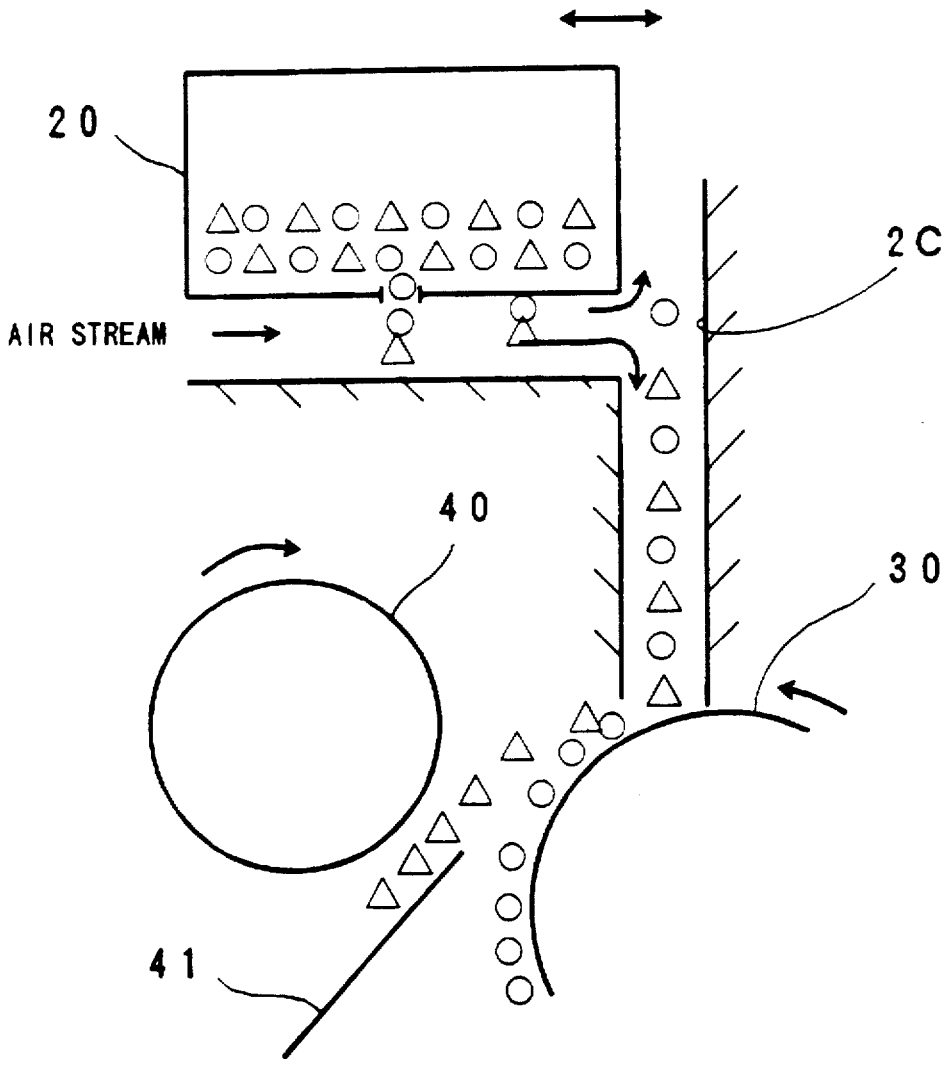
FIG. 14 is a view showing another modification of a friction electrifying unit.

Further, while in the above embodiments, the sorted material is allowed to fall naturally from the friction electrifying unit to the feeding unit, this is not limitative. For example, when the sorted material consists of pulverized pieces, there may be a case where materials electrified differently mechanically mesh one another. As shown in FIG. 14, these different materials may be separated by causing an air stream carrying the two materials to a collision wall 2C before one of the separated materials is supplied to the feed roller 30.

Figure 15:
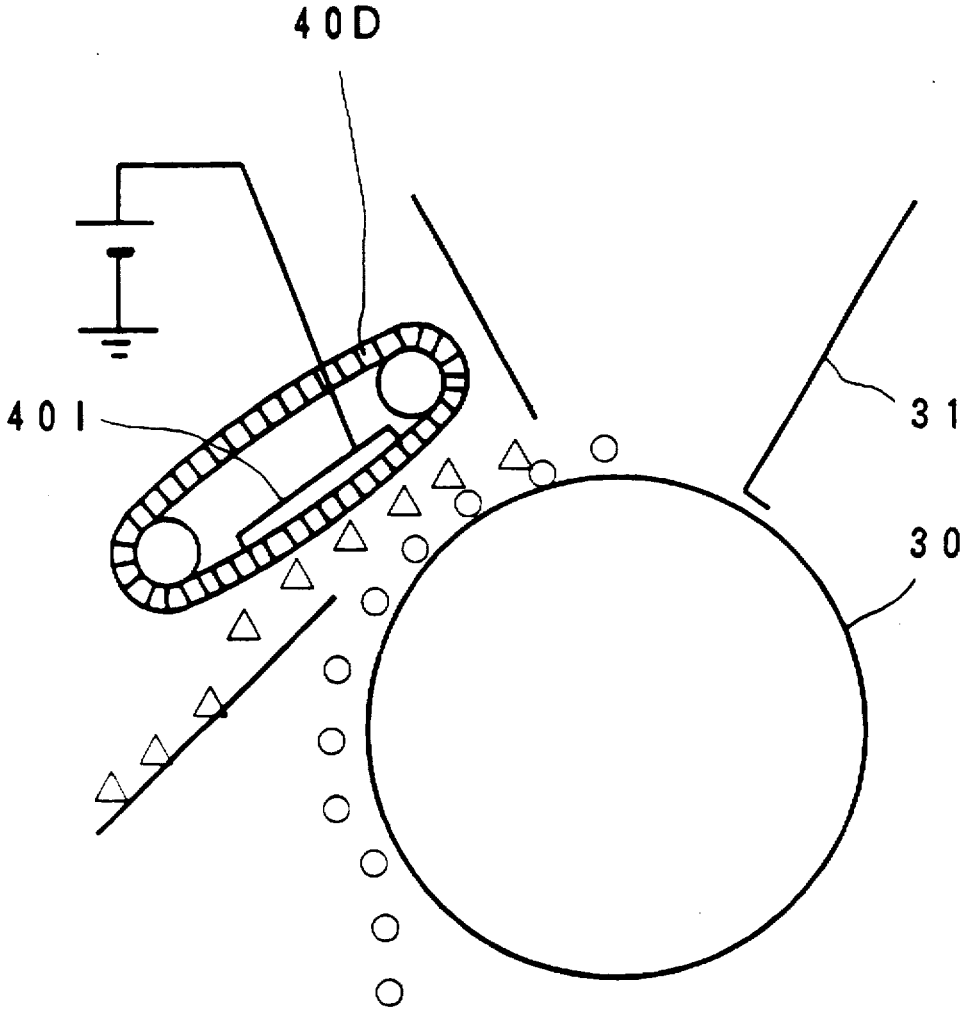
FIG. 15 is a view showing a modification of a rotary electrode.
Figure 16:
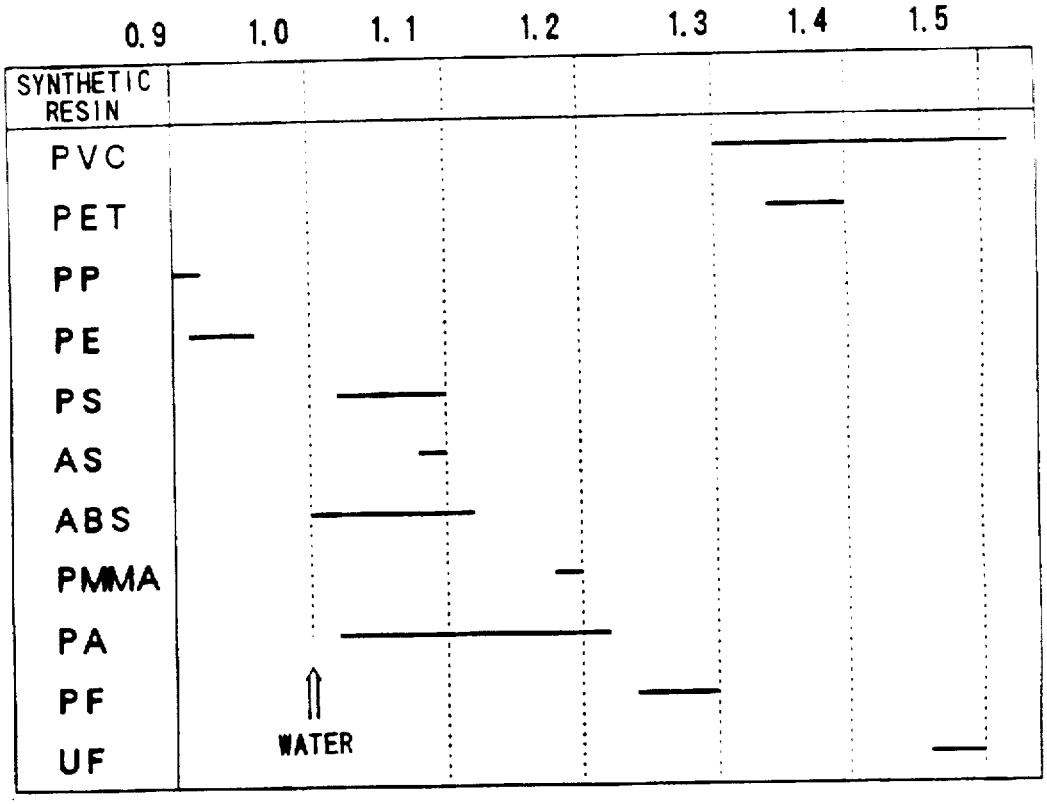
FIG. 16 is a graph showing the distribution of the specific gravities of various plastic materials.
Figure 17:
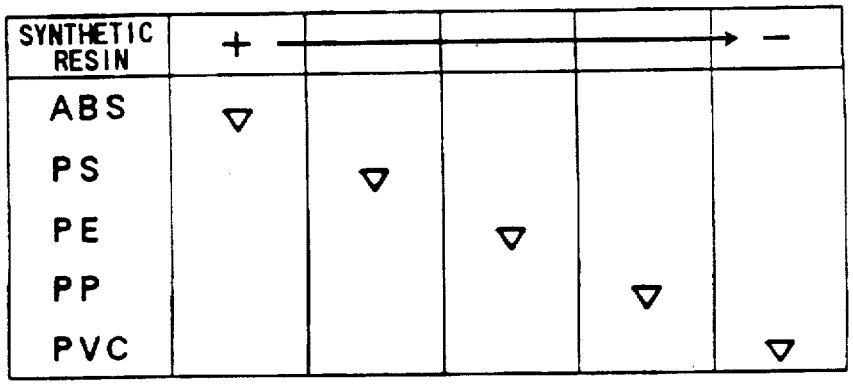
FIG. 17 is a graph showing a electrifying series of general-purpose resins.
Figure 18:
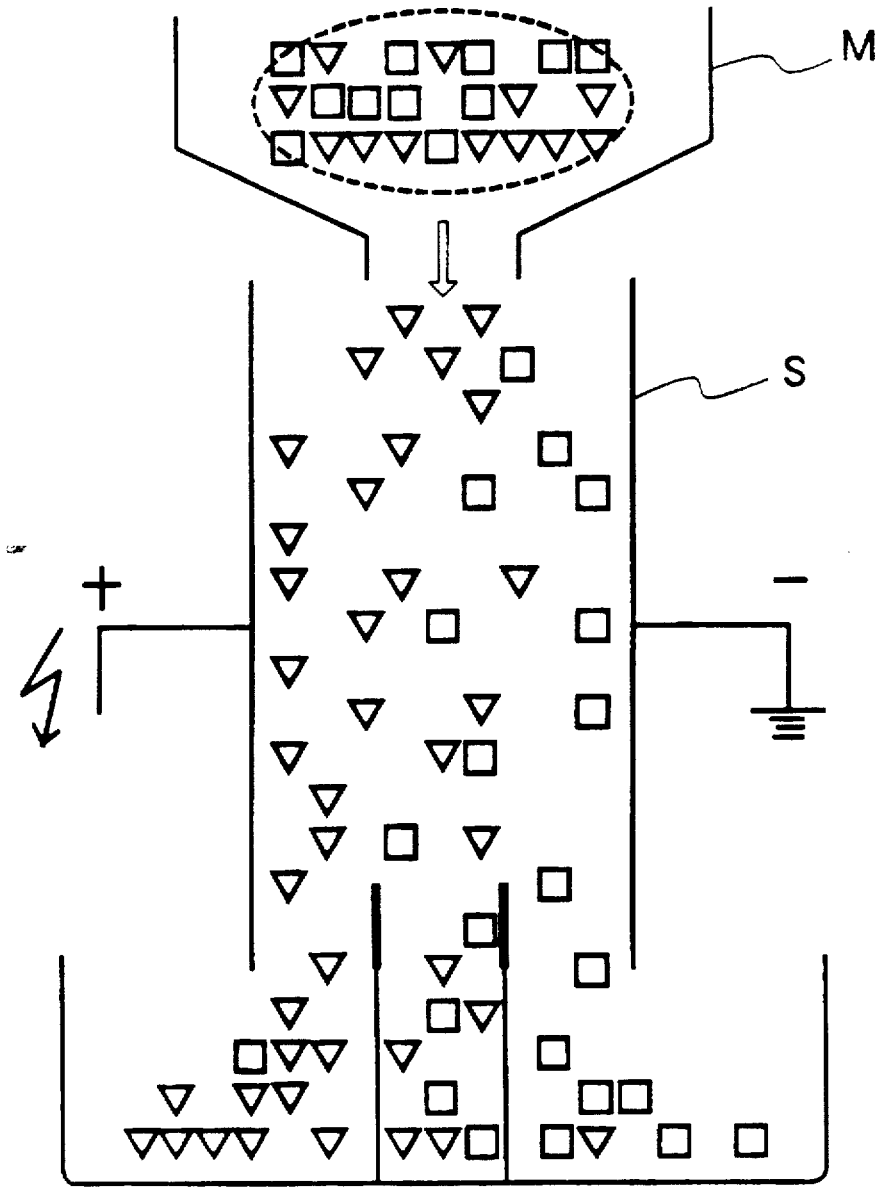
FIG. 18 (PRIOR ART)
FIG. 18 is a view illustrating the principles underlying prior art apparatus.

Further, while in the above embodiments, each rotary electrode is constituted by a rotary cylinder, this is not limitative. For example, FIG. 15 shows a rotary electrode which is constituted by divided electrodes 40D connected to one another in the form like a caterpillar. A voltage application electrode 40I connected to voltage application means is provided only on a portion facing the feed roller. Voltage is applied to the divided electrodes 40D while in contact with the voltage application electrode 401. When this state is over, voltage is no longer applied, thus allowing the attracted sorted material to fall onto the separating plate 41.

Further, in the second embodiment, the preliminary friction electrifying unit may be omitted in case when high sorting accuracy is not required.

What is claimed is:

1. A friction electrifying-type electrostatic sorting apparatus, comprising:

a preliminary friction electrifying unit for preliminarily electrifying a sorted material by providing a friction a friction electrifying unit for further electrifying the preliminary friction electrified sorted material, said friction electrifying unit having a chamber with a lining of an electrifying material provided on an inner wall of the chamber and a mechanism for moving the chamber to provide said further electrifying of the preliminary friction electrified sorted material by a corresponding movement of the chamber lining;

a feeding unit for supplying the sorted material having been electrified by said friction electrifying unit; and an electrostatic sorting unit for electrostatically sorting the electrified sorted material supplied from said feeding unit according to the electrified state of the electrified sorted material by exposing the electrified sorted material to an electrostatic field.

2. The friction electrifying-type electrostatic sorting apparatus according to claim 1, wherein said preliminary friction electrifying unit includes a transporting unit having an inner surface including a lining of a material containing a synthetic resin for promoting the preliminary electrifying of the sorted material, whereby the sorted material is electrified by said lining while being transported.

3. The friction electrifying-type electrostatic sorting apparatus according to claim 1, further comprising:

a shredding unit for shredding the sorted material;

a screening unit for finely screening the sorted material shredded by said shredding unit for different sizes; and a wind sorting unit for sorting the sorted material having been screened by said screening unit by supplying an air stream at a predetermined speed to the sorted material into heavy and light sorted materials, said shredding unit, screening unit and wind sorting unit being provided on the upstream side of said friction electrifying unit.

4. The friction electrifying-type electrostatic sorting apparatus according to claim 1, wherein said friction electrifying unit comprises a rotary trommel having a hollow cylindrical body, with a lining provided on an inclined inner cylindrical surface.

5. The friction electrifying-type electrostatic sorting apparatus according to claim 1, further comprising:

a collision unit having a collision wall to which the electrified are sorted materials and collided by an air stream carrying the electrified and sorted material and are separated into different materials having different polarity.

6. A friction electrifying-type electrostatic sorting apparatus, comprising:

a preliminary friction electrifying unit for preliminarily electrifying a sorted material by providing a friction;

a friction electrifying unit for further electrifying the sorted material having been preliminarily electrified by said preliminary friction electrifying unit;

a feeding unit for supplying the sorted material having been electrified by said friction electrifying unit;

an electrostatic sorting unit for electrostatically sorting the electrified material supplied from said feeding unit according to the electrified state of the sorted material by providing the sorted material in an electrostatic field;

wherein said preliminary friction electrifying unit includes a transporting unit having an inner surface including a lining of a material containing a synthetic resin for promoting the preliminary electrifying of the sorted material, whereby the sorted material is electrified by said lining while being transported, and wherein said transporting unit includes a transporting pipe having the lining of electrifying material containing a synthetic resin provided on an inner surface of said pipe for the preliminary electrifying of the sorted material and a cyclone having an inner surface for further preliminarily electrifying the sorted material contacting said cyclone inner surface for a long enough period of time; and said friction electrifying unit comprises a reciprocal friction electrifying unit having a lining of an electrifying material provided on an inner surface of said reciprocal electrifying unit for further electrifying the sorted material.

7. The friction electrifying-type electrostatic sorting apparatus according to claim 6, wherein said feeding unit includes a first feed roller disposed near an outlet opening of said friction electrifying unit to supply by its rotation the sorted material having been electrified by said friction electrifying unit.

8. The friction electrifying-type electrostatic sorting apparatus according to claim 7, wherein said electrostatic sorting unit comprises a first rotary electrode with a positive or negative voltage applied thereto disposed opposed to said first feed roller for attracting and sorting the sorted material electrified to a polarity differently from a polarity of the voltage applied thereto.

9. The friction electrifying-type electrostatic sorting apparatus according to claim 8, further comprising:

a first separating plate disposed between said first feed roller and said first rotary electrode, for separating the differently electrified and sorted material in the electrostatic field.

10. The friction electrifying-type electrostatic sorting apparatus according to claim 9, further comprising:

a second separating plate disposed under said first feed roller, for separating the sorted material falling due to gravity and the sorted material forced to fall down from said first feed roller.

11. The friction electrifying-type electrostatic sorting apparatus according to claim 10, wherein said first rotary electrode is constituted by a plurality of divided electrodes disposed on an outer periphery of a cylindrical member rotated in synchronism to said first feed roller, and an additional electrode is provided at the lower end of the first and second separating plates, the additional electrode being given applied voltage of the same polarity as the separated and sorted material for attracting the differently electrified and sorted material contained in the sorted material.

12. The friction electrifying-type electrostatic sorting apparatus according to claim 6, further comprising:

swirl causing means for causing a swirl of the sorted material in the transporting pipe to cause sufficient electrifying of the sorted material by friction electrifying before the sorted material is supplied to the cyclone.

13. The friction electrifying-type electrostatic sorting apparatus according to claim 10, wherein at least one set of a second feed roller and a second rotary electrode similar to said first feed roller and said first rotary electrode is provided down-stream of said first feed roller and said first rotary electrode.

14. The friction electrifying-type electrostatic sorting apparatus according to claim 13, further comprising:

a controller for determining the air flow of a blower, the friction electrifying time of said friction electrifying unit, the voltage applied to and polarity of the first rotary electrode, and the inclination of the first and second separating plates and so forth according to preliminarily stored data in dependence on the kind of the sorted material, thereby outputting respective control signals; and a control mechanism for controlling the air flow of the blower, the friction electrifying time of said friction electrifying unit, the voltage applied to and polarity of the first rotary electrode and the inclination of the first and second separating plates according to the control signals from said controller.

15. The friction electrifying-type electrostatic sorting apparatus according to claim 14, wherein said friction electrifying unit includes an electrified state sensor for detecting a predetermined electrified state of the sorted material, and for providing an output to the controller indicating the detecting of the predetermined electrified state of the sorted material, said controller outputting a further control signal to said feeding unit for supplying the sorted material in the predetermined electrified state to the first feed roller, said electrified state sensor is provided in an accommodation box for accommodating the sorted material.

16. The friction electrifying-type electrostatic sorting apparatus according to claim 6, wherein said cyclone comprises a conical cyclone rotated by a motor through a gear, for providing a centrifugal force to the sorted material, whereby the intensity of friction electrifying in the sorted material is intensified.

17. The friction electrifying-type electrostatic sorting apparatus according to claim 6, wherein said cyclone comprises a pyramidal cyclone having an elliptical motion provided by a motor through crankshaft and a connecting rod, for providing reciprocating force to the sorted material, whereby the intensity of friction electrifying in the sorted material is increased.

18. The friction electrifying-type electrostatic sorting apparatus according to claim 6, wherein said transporting pipe comprises a helical transporting pipe for providing a long effective distance of transport and friction provision.

19. The friction electrifying-type electrostatic sorting apparatus according to claim 9, further comprising:

a rotary electrode having a plurality of divided electrodes and an arcuate contact provided at an lower end of said first separating plate.

20. The friction electrifying-type electrostatic sorting apparatus according to claim 8, wherein said first rotary electrode comprises divided electrodes provided on an outer wall of a caterpillar and a voltage application electrode connected to a voltage application source and provided on a portion opposed to said first feed roller.

21. A friction electrifying-type electrostatic sorting apparatus, comprising:

a preliminary friction electrifying unit including a transporting unit and an output unit, said transporting unit transporting sorted material to the output unit, said transporting unit providing a first increment of preliminary friction electrification to the sorted material and the output unit providing a second increment of preliminary friction electrification to the sorted material;

a friction electrifying unit receiving the preliminary friction electrified sorted material from the output unit and further electrifying the preliminary friction electrified sorted material;

a feeding unit for receiving the further electrified sorted material from said friction electrifying unit; and an electrostatic sorting unit receiving the further electrified sorted material from the feeding unit and for electrostatically sorting the further electrified sorted material according to the electrified state of the further electrified sorted material by exposing the further electrified sorted material to an electrostatic field.

* * * * *

UNITED STATES PATENT AND TRADEMARK OFFICE

CERTIFICATE OF CORRECTION

PATENT NO. : 5,746,320

DATED : May 5, 1998

INVENTOR(S) : Yoshihisa FUJITA, ET AL.

It is certified that error appears in the above-identified patent and that said Letters Patent is hereby corrected as shown below:

On the title page, Item [73], the first assignee's name is incorrect. It should read:

--Toyota Tsusho Corporation--

Signed and Sealed this

FourthDay of August, 1998

Bruce Lehman

*Attest:*

BRUCE LEHMAN

*Attesting Officer*

*Commissioner of Patents and Trademarks*